US007805096B2

(12) United States Patent
Ishiguro et al.

(10) Patent No.: US 7,805,096 B2
(45) Date of Patent: Sep. 28, 2010

(54) TONER CONVEYING DEVICE, TONER SUPPLY DEVICE AND IMAGE FORMING APPARATUS USING THESE

(75) Inventors: Yasuyuki Ishiguro, Higashiosaka (JP); Takeshi Okuda, Kizugawa (JP); Takeshi Wakabayashi, Kizugawa (JP); Jun Yamaguchi, Ikoma (JP); Hiroshi Kawahito, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 496 days.

(21) Appl. No.: 11/907,028

(22) Filed: Oct. 9, 2007

(65) Prior Publication Data

US 2008/0089718 A1 Apr. 17, 2008

(30) Foreign Application Priority Data

Oct. 16, 2006 (JP) ..... 2006-281666

(51) Int. Cl.
*G03G 15/08* (2006.01)

(52) U.S. Cl. ..... 399/258

(58) Field of Classification Search ..... 399/120, 399/254, 258, 260

See application file for complete search history.

(56) References Cited

U.S. PATENT DOCUMENTS 6,366,755 B1 4/2002 Takashima

FOREIGN PATENT DOCUMENTS

| | | |
|---|---|---|
| JP | 04-174467 | 6/1992 |
| JP | 2001-296731 | 10/2001 |
| JP | 2004-361785 A | 12/2004 |
| JP | 2005-165003 | 6/2005 |
| JP | 2006-267945 | 10/2006 |

OTHER PUBLICATIONS

Machine translation of Adachi et al. (JP 2005-165,003, Listed in IDS).*
Machine translation of Ishiguro et al. (JP 2006-267,945, Listed in IDS).*

* cited by examiner

*Primary Examiner*—David M Gray
*Assistant Examiner*—Rodney Bonnette
(74) *Attorney, Agent, or Firm*—Nixon & Vanderhye, PC

(57) ABSTRACT

In a supply passage assembly having a toner passage arranged under a toner bottle for conveying toner supplied from the toner bottle to a developing unit arranged below, a toner conveying pipe for forming the toner passage is formed of an elastic material and a toner conveying pipe deforming member is arranged adjacent to the toner conveying pipe for elastically deforming the toner conveying pipe.

11 Claims, 15 Drawing Sheets

TONER CONVEYING DEVICE, TONER SUPPLY DEVICE AND IMAGE FORMING APPARATUS USING THESE

This Nonprovisional application claims priority under 35 U.S.C. §119(a) on Patent Application No. 2006-281666 filed in Japan on 16 Oct. 2006, the entire contents of which are hereby incorporated by reference.

BACKGROUND OF THE TECHNOLOGY

1. Field of the Technology

The present invention relates to a toner conveying device, a toner supply device and an image forming apparatus using these, in particular relating to a toner conveying device, toner supply device for use in an image forming apparatus that performs image forming with toner and an image forming apparatus using these.

2. Description of the Prior Art

Conventionally, in image forming apparatuses such as copiers, facsimile machines and the like using toner, toner is supplied to the developing unit by means of a toner supply device including a toner cartridge and the like so as to achieve continuous operation of image output.

As a known method of supplying toner to a developing unit by means of a toner supply device, there is a configuration in which toner is supplied from a toner cartridge to the developing unit by way of a toner conveying device.

In the toner supply device in which a toner cartridge is arranged above the developing unit, the toner conveying device is constructed so that a toner conveying path extending vertically is formed to convey the toner to the developing unit located below.

Recently in the field of image forming apparatuses, there is a trend towards high-resolution configurations. With this trend, the particle size of the toner also has become finer. Generally, the finer the toner, the worse the fluidity of the toner is. As a result, the toner becomes liable to stagnate and solidify in the toner conveying path of the toner conveying device. To deal with this, various ways of measures to solve this problem with the toner conveying device have been taken.

As a prior art example, there is a proposal of an image forming apparatus having four vertically arranged developing units for different colors wherein each developing unit is supplied with toner from a toner hopper (corresponding to a toner cartridge) and is constructed so as to be movable up and down because these developing units need to oppose a photoreceptor drum when they are operated. To achieve this operation, the toner conveying path for supplying toner from the toner hopper to each developing unit is formed of a corrugated pipe (see patent document 1: Japanese Patent Application Laid-open No. Hei 4-174467).

Arranged further at the side of this corrugated pipe is a rotator which has a plurality of projections provided on its peripheral side and is driven to rotate by a motor. That is, in patent document 1, this rotator is adapted to rotate so that the projections beat the outer peripheral surface of the corrugated pipe and strike off the toner that stagnates in the inner pleats of the corrugated pipe.

As another prior art example, there is also a proposal of an image forming apparatus which has four developing units for different colors arranged horizontally in tandem, wherein each color of toner is supplied from a separate toner cartridge to the corresponding developing unit by way of first and second conveying passages, the first passage being arranged horizontally and incorporating an auger and the second passage being arranged vertically and incorporating a spring agitator. In this configuration, the spring agitator is adapted to move up and down with rotation of the auger in the first passage to thereby prevent adherence of toner to the inner wall of the second conveying passage (see patent document 2: Japanese Patent Application Laid-open 2001-296731).

Further, there is still another proposal of an image forming apparatus which, in addition to a configuration where a toner conveying path is vibrated as described above, comprises a toner (developer) conveyance control means for controlling the amount of toner conveyance so as to control the amount of toner to be supplied through the toner conveying path (see patent document 3: Japanese Patent Application Laid-open 2005-165003).

However, any of the above conventional configurations has the problem that stagnation and solidification of toner in the toner conveying path that is arranged vertically cannot be prevented properly.

Specifically, in the configuration of patent document 1, since the vertical toner conveying passage is formed of a corrugated pipe, it is not so easy or possible to prevent stagnation and solidification of toner inside the toner conveying passage in terms of structural reason of the conveying passage. Further, since this configuration is constructed so that part of the toner conveying passage is impacted or vibrated by the rotator, there is also the problem that stagnation or solidification of toner is liable to occur at the areas away from the position of the rotator.

Also, in the configuration of patent document 2, since a spring agitator is arranged inside the second conveying passage that is arranged vertically, toner becomes prone to stagnate or solidify on the surface of the spring agitator. More explicitly, the spring agitator itself is liable to cause the problem of hindering toner conveyance.

Further, in the configuration of patent document 3, since the amount of toner being supplied through the toner conveying passage is controlled, it is necessary to vary the sectional area through which toner passes, in accordance with the amount of toner to be supplied, resulting in configuration complexity. That is, there occurs the problem that the apparatus configuration becomes complex and the maintenance performance is also affected.

SUMMARY OF THE TECHNOLOGY

The present technology has been devised in view of the above conventional problems, it is therefore an object to provide a toner conveying device, a toner supply device and an image forming apparatus using these, which, by use of a simple structure, can realize stable toner conveyance by inhibiting the occurrence of toner blocking in the path of toner conveyance.

In order to achieve the above object, the toner conveying device, the toner supply device and the image forming apparatus using these are configured as follows.

A toner conveying device in accordance with the first aspect is one that is arranged under a toner container for storing toner, comprising: a toner conveying passage for conveying toner supplied from the toner container to a developing unit arranged below, the toner conveying passage formed of an elastic material; and a toner conveying passage deforming portion arranged adjacent to the toner conveying passage for elastically deforming the toner conveying passage.

A toner conveying device in accordance with the second aspect is characterized in that, in addition to the above first configuration, the toner conveying passage is formed at the top end thereof with a toner input port that is connected to the toner container side and at the bottom end thereof with a toner discharge port that is connected to the developing unit side, and the path of toner conveyance from the toner input port to the toner discharge port is formed to be straight.

A toner conveying device in accordance with the third aspect is characterized in that, in addition to the above first or second configuration, part of the exterior wall of the toner conveying passage is formed of an elastic material.

A toner conveying device in accordance with the fourth aspect is characterized in that, in addition to any one of the above first to third configurations, the toner conveying passage deforming portion changes the sectional shape of the toner conveying passage by giving an external force from the outside of the toner conveying passage.

A toner conveying device in accordance with the fifth aspect is characterized in that, in addition to any one of the above first to fourth configurations, the toner conveying passage deforming portion comprises a pressing member for pressing part of the external wall of the toner conveying passage in a direction that is approximately perpendicular to the toner conveying direction.

A toner conveying device in accordance with the sixth aspect is characterized in that, in addition to the above fifth configuration, the toner conveying passage deforming portion is adapted to change the pressing force of the pressing member acting on the toner conveying passage with passage of time.

A toner conveying device in accordance with the seventh aspect is characterized in that, in addition to the above fifth or sixth configurations, the pressing member acts external force on a part that is formed of an elastic material in the toner conveying passage.

A toner conveying device in accordance with the eighth aspect is characterized in that, in addition to the above fifth or sixth configurations, the pressing member acts external force on apart that is not formed of an elastic material in the toner conveying passage.

A toner conveying device in accordance with the ninth aspect having a configuration defined in any one of the above first to eighth aspects, further comprises a toner feeder for feeding toner from the toner container to the toner conveying passage, and is characterized in that the toner conveying passage deforming portion moves in linkage with the driving operation of the toner feeder.

Further, a toner supply device in accordance with the tenth is one that includes a toner container for storing toner and a toner conveying portion arranged under the toner container and having a toner conveying passage for conveying toner supplied from the toner container to a developing unit arranged below, so as to feed the toner supplied from the toner container to the developing unit, and is characterized in that a toner conveying device defined in anyone of the above first to ninth aspects is the toner conveying portion.

An image forming apparatus in accordance with eleventh aspect is one in which a toner supply device including a toner container for storing toner and a toner conveying portion arranged under the toner container and having a toner conveying passage for conveying toner supplied from the toner container to a developing unit arranged below, so as to feed the toner supplied from the toner container to the developing unit is mounted, and is characterized in that a toner supply device defined in the tenth aspect is used as the toner supply device.

According to the first aspect, since the toner conveying passage can be elastically deformed in an easy manner by the toner conveying passage deforming portion, the lumps of toner which built up inside the toner conveying passage can be loosened by deforming the toner conveying passage, hence it is possible, with a simple configuration, to realize stable conveyance of toner by inhibiting occurrence of toner blocking in the path of toner conveyance.

According to the second aspect, in addition to the effect obtained by the first aspect, toner that passes through the toner conveying passage can be conveyed smoothly, hence it is possible to inhibit occurrence of toner blocking.

According to the third aspect, in addition to the effect obtained by the first or second aspect, the toner conveying passage can easily deformed by use of the elastic part.

According to the fourth aspect, in addition to the effect obtained by any one of the first to third, it is possible to easily loosen solidified toner inside toner conveying passage.

According to the fifth aspect, in addition to the effect obtained by any one of the first to fourth aspects, it is possible to easily crush the toner solidified inside the toner conveying passage by deforming the sectional shape that is approximately perpendicular to the toner conveying direction, with the pressing member.

According to the sixth aspect, in addition to the effect obtained by the fifth aspect, the deformed condition of the toner conveying passage is changed with passage of time, so that it is possible to obtain a more effective toner loosing function.

According to the seventh aspect, in addition to the effect obtained by the fifth or sixth aspect, it is possible to easily change the shape of the toner conveying passage by deforming the elastic part with the pressing member.

According to the eighth aspect, in addition to the effect obtained by the fifth or sixth aspect, since the elastic part deforms when the part that is not formed of elastic material in the toner conveying passage is pressed and displaced by the pressing member, the toner conveying passage can be easily deformed.

According to the ninth aspect, in addition to the effect obtained by any one of the first to eighth aspects, it is possible to simplify the device configuration and promote space-saving without the need to provide a separate drive source for the toner conveying passage deforming portion.

According to the tenth aspect, since the loosening effect can be obtained across the entire toner conveying passage by elastically deforming the toner conveying passage, it is possible to achieve stable toner supply to the developing unit without causing any blocking of the supplied toner in the toner conveying passage, hence this makes it possible for the developing unit to stably form high quality images.

According to the image forming apparatus defined in the eleventh aspect, since the loosening effect can be obtained across the entire toner conveying passage by elastically deforming the toner conveying passage, it is possible to achieve stable toner supply without causing any blocking of the supplied toner in the toner conveying passage, hence it is possible to realize an image forming apparatus that is optimized for large-volume printing.

DESCRIPTION OF THE PREFERRED EMBODIMENTS

The best mode for carrying out the present technology will be described with reference to the drawings.

Figure 1:
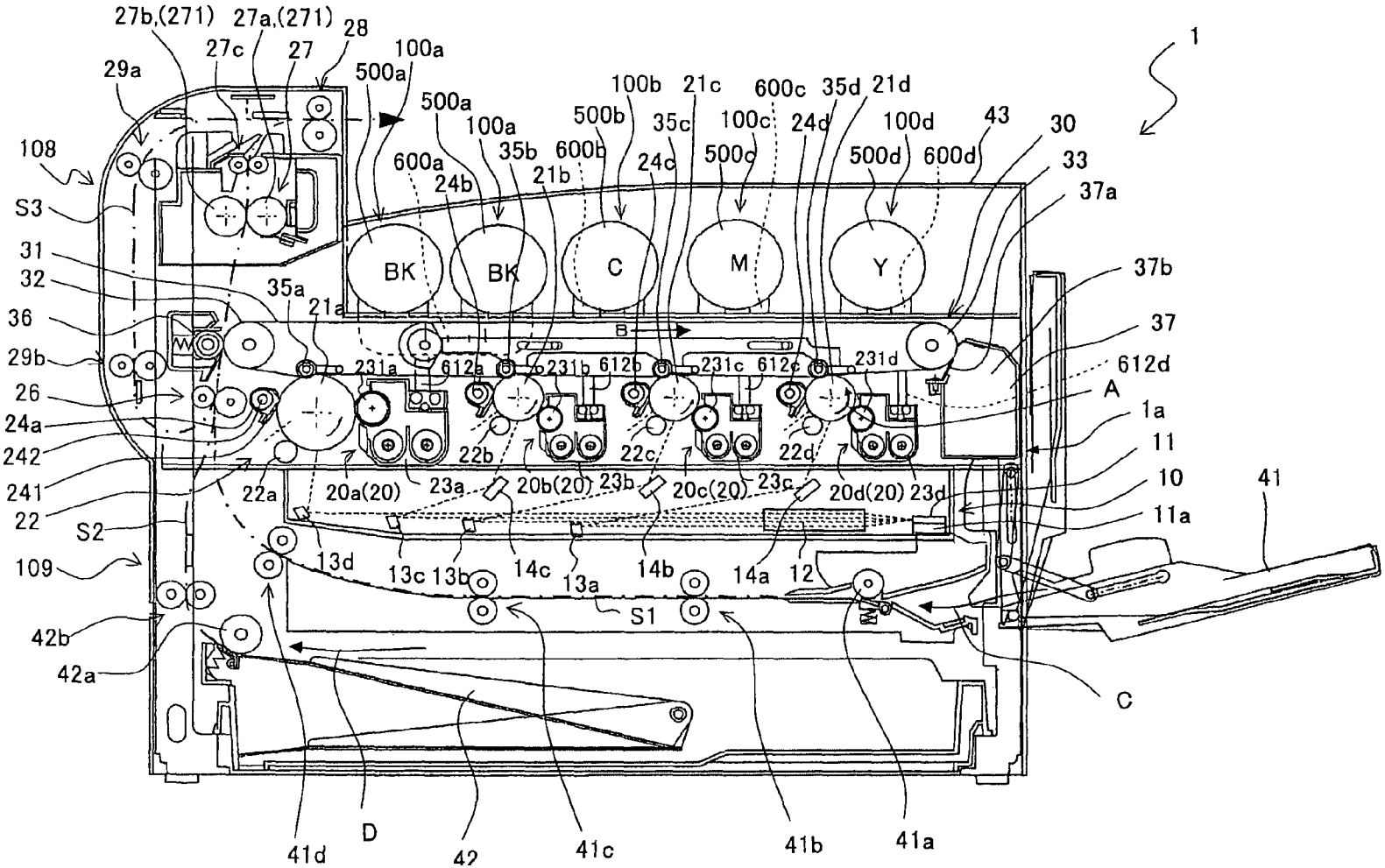
FIG. 1 is an illustrative view showing an overall configuration of an image forming apparatus adopting a toner conveying device.

FIG. 1 is an example of the mode for carrying out the present technology, and is an illustrative view showing an overall configuration of an image forming apparatus adopting a toner conveying device.

Figure 2:
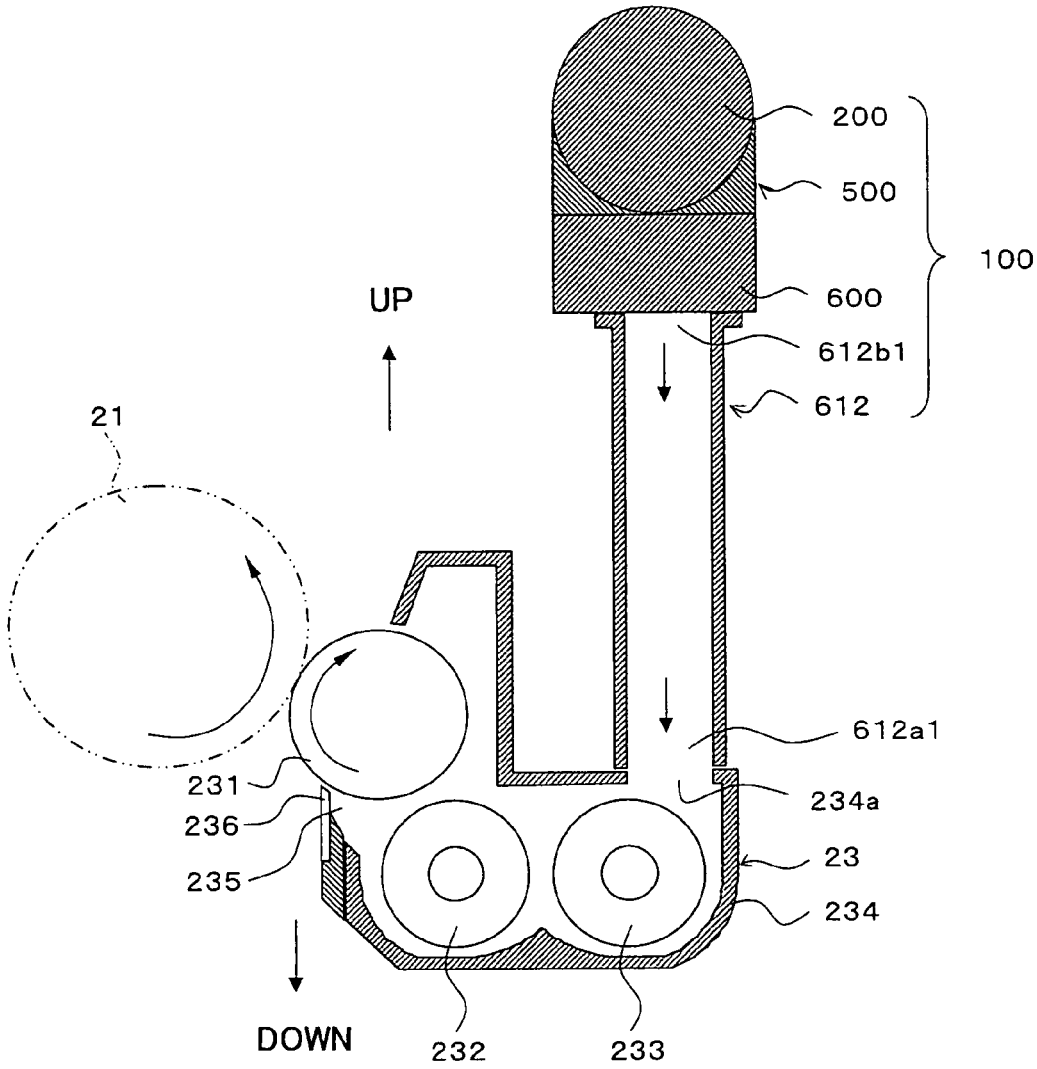
FIG. 2 is a schematic side sectional view showing a configuration of a developing unit and a toner supply device that constitute the image forming apparatus.

As shown in FIG. 1, the present embodiment is realized in a developing unit 23 (23*a*, 23*b*, 23*c* or 23*d*) for use in an image forming apparatus 1 in which developer images that are formed on photoreceptor drums 21 (21*a*, 21*b*, 21*c* and 21*d*) with developers supplied from developing rollers 231 (231*a*, 231*b*, 231*c* and 231*d*) in accordance with image data are transferred to a recording sheet by a transfer process, and each developing unit is equipped with a toner supply device 100 (100*a*, 100*b*, 100*c* or 100*d*) having a toner bottle (toner container) 200 (200*a*, 200*b*, 200*c* or 200*d*: FIG. 2) for storing toner, a toner supply assembly mounting mechanism 600 (600*a*, 600*b*, 600*c* or 600*d*) as a toner feed device for reserving toner supplied from the toner bottle 200 and feeding the toner after agitation to developing unit 23 and a supply passage assembly 612 (612*a*, 612*b*, 612*c* or 612*d*) as a toner conveying device, so as to perform automatic toner supply to the developing unit 23.

As shown in FIG. 1, image forming apparatus 1 to which developing units 23 according to the present embodiment are mounted includes: a plurality of process printing units (image forming portion) 20 (20*a*, 20*b*, 20*c* and 20*d*) each having a photoreceptor drum 21 (21*a*, 21*b*, 21*c* or 21*d*) on which a developer image (which will be referred to as "toner image" hereinbelow) is formed with a developer (which will be referred to as "toner" hereinbelow) corresponding to the color of color-separated image information and a developing unit 23 for supplying the developer to the photoreceptor drum 21 surface; an exposure unit (light scanning device) 10 for creating electrostatic latent images on photoreceptor drums 21 of individual colors by illumination of laser beams in accordance with image information; a transfer belt unit 30 having an endless transfer belt 31 for conveying toner images; and a fixing unit 27 for thermally fixing the toner images transferred to recording paper, by means of a heat roller 27*a* and a pressing roller 27*b*.

To begin with, the overall configuration of image forming apparatus 1 will be described.

As shown in FIG. 1, image forming apparatus 1 according to the present embodiment is a so-called digital color printer which is adapted to output a color image by separating image information into colors and forming images of individual colors, is mainly composed of an image forming portion 108 and a paper feed portion 109, and forms multi-color images or monochrome images on recording paper in accordance with a print job sent from an information processor (not illustrated) such as a personal computer etc., externally connected.

Image forming portion 108 forms multi-color images based on electrophotography with yellow (Y), magenta (M), cyan (C) and black (BK) colors. This image forming portion is mainly composed of exposure unit 10, process printing units 20, fixing unit 27, transfer belt unit 30 having transfer belt 31 as a transfer portion, transfer roller 36 and a transfer belt cleaning unit 37.

In the overall arrangement of image forming portion 108, fixing unit 27 is disposed on the top at one end side of a housing 1*a* of image forming apparatus 1, transfer belt unit 30 is arranged under the fixing unit 27 from one end side to the other end side of housing 1*a*, process printing units 20 are disposed under the transfer belt unit 30, and exposure unit 10 is disposed under these process printing units 20.

Further, transfer belt cleaning unit 37 is arranged on the other end side of transfer belt unit 30. Also, a paper output tray 43 is arranged contiguous to fixing unit 27, over image forming portion 108. Paper feed portion 109 is arranged under the image forming portion 108.

In the present embodiment, as process printing units 20, four process printing units 20*a*, 20*b*, 20*c* and 20*d*, corresponding to individual colors, i.e., black (BK), cyan (C), magenta (M) and yellow (Y) are arranged sequentially along transfer belt 31.

These process printing units 20 (20*a*, 20*b*, 20*c* and 20*d*) are arranged in parallel to each other, in the approximately horizontal direction (in the left-to-right direction in the drawing) in housing 1*a*, and include respective photoreceptor drums 21 (21*a*, 21*b*, 21*c* and 21*d*) as the image support for each individual associated color, respective chargers (charging portion) 22 (22*a*, 22*b*, 22*c* and 22*d*) for charging the photoreceptor drums 21, respective developing units (developing portion) 23 (23*a*, 23*b*, 23*c* and 23*d*) and respective cleaner units 24 (24*a*, 24*b*, 24*c* and 24*d*) and other components.

Here, the symbols a, b, c, and d added to the constituents for individual colors show correspondence to black (BK), cyan (C), magenta (M) and yellow (Y), respectively. In the description hereinbelow, however, the constituents provided for each color are generally referred to as photoreceptor drum 21, charger 22, developing unit 23, and cleaner unit 24, except in the case where the constituents corresponding to a specific color need to be specified.

Photoreceptor drum 21 is arranged so that part of its outer peripheral surface comes into contact with the surface of transfer belt 31 while charger 22 as an electric field generator, developing unit 23 and cleaner unit 24 are arranged along, and close to, the outer peripheral surface of the drum.

As charger 22, a corona-wire charger is used and arranged, at a position on the approximately opposite side across photoreceptor drum 21, from transfer belt unit 30 and close to the outer peripheral surface of photoreceptor drum 21. Though in the present embodiment a corona-wire charger is used as charger 22, any type of charger such as a fur brush type charger, magnetic brush type charger, roller-type charger, saw-toothed type charger, ion-generation charging device etc., can be used in place of the corona-wire charger without limitation as long as it can provide the desired charge performance to the photoreceptor drum.

Developing units 23*a*, 23*b*, 23*c* and 23*d* hold associated toners of black (BK), cyan (C), magenta (M) and yellow (Y) colors, each developing unit 23 being arranged on the downstream side of charger 22 with respect to the rotational direction of the photoreceptor drum (in the direction of arrow A in the drawing).

In developing units 23*a*, 23*b*, 23*c* and 23*d*, in order to support high-speed and large-volume printing, toner supply devices 100*a*, 100*b*, 100*c* and 100*d* equipped with five toner supply assemblies 500*a*, 500*b*, 500*c* and 500*d* for supplying developers to respective developing units 23*a*, 23*b*, 23*c* and 23*d* are provided. Developing rollers 231*a*, 231*b*, 231*c* and 231*d* are arranged opposing respective photoreceptor drums 21*a*, 21*b*, 21*c* and 21*d*, so as to supply the associated colors of toners to the electrostatic latent images formed on the outer peripheral surfaces of photoreceptor drums 21*a*, 21*b*, 21*c* and 21*d*, respectively and visualize them.

As the developers to be supplied, developers of black (BK), cyan (C), magenta (M) and yellow (Y) colors are stored in toner supply assemblies 500*a*, 500*b*, 500*c* and 500*d*, respectively.

Here, two toner supply assemblies 500*a* for black (BK) developer are arranged side by side in order to support large-volume printing, taking into account the practice that monochrome printing is usually used most frequently.

Each toner supply assembly 500 is arranged at a position approximately directly above the developing unit 23 of the corresponding developer, and is connected to the corresponding developing unit 23 by way of a developer supply passage assembly (toner conveying device) 612 (612*a*, 612*b*, 612*c* or 612*d*).

Here, supply passage assembly 612*a* for supplying the black (BK) developer is constructed so that the developer from two toner supply devices 100*a* and 100*a* can be put together and supplied to developing unit 23*a*.

Cleaner unit 24 is arranged on the upstream side of charger 22 with respect to the rotational direction of the photoreceptor drum. Cleaner unit 24 has a cleaning blade 241 and is configured so that the cleaning blade 241 is positioned in abutment with the outer peripheral surface of photoreceptor 21 so as to scrape and collect the leftover toner off the photoreceptor drum 21. A reference numeral 242 in the drawing designates a conveying screw for conveying the collected toner.

In the present embodiment, cleaning blade 241 is used but the cleaning unit is not limited to this configuration. One or more cleaning blades may be used or a fur-brush or magnetic brush may be used alone. Alternatively, a fur-brush or magnetic brush may be used in combination with a cleaning blade. That is, any configuration may be used as long as it can scrape and collect the leftover toner off the photoreceptor drum 21.

Exposure unit 10 is mainly composed of a box-shaped housing, a laser scanning unit (LSU) 11 having a laser illuminator 11*a* incorporated therein, a polygon mirror 12 and reflection mirrors 13*a*, 13*b*, 13*c*, 13*d*, 14*a*, 14*b* and 14*c* etc. for reflecting the laser beams for associated colors.

The laser beam emitted from the laser illuminator of laser scanning unit 11 is separated into color components by polygon mirror 12 and an unillustrated f-θ lens, then the separated components of light are reflected by reflection mirrors 13*a* to 13*d* and 14*a* to 14*c* to illuminate the respective photoreceptor drums 21*a*, 21*b*, 21*c* and 21*d* of individual colors.

Here, concerning laser scanning unit 11, a writing head made up of an array of light emitting devices such as EL (electro luminescence), LED (light emitting diode) and others, may be used instead of the laser illuminator. Also, alight source in combination with a liquid crystal shutter may be used. That is, any configuration can be used as long as it can create an electrostatic latent image on the photoreceptor drum 21 surface.

As shown in FIG. 1, transfer belt unit 30 is essentially composed of transfer belt 31, a transfer belt drive roller 32, a transfer belt driven roller 33 and intermediate transfer rollers 35*a*, 35*b*, 35*c* and 35*d*.

In the following description, any of intermediate transfer rollers 35*a*, 35*b*, 35*c* and 35*d* will be referred to as intermediate transfer roller 35 when general mention is made.

Transfer belt 31 is formed of an endless film of about 75 μm to 120 μm thick. Transfer belt 31 is essentially made from polyimide, polycarbonate, thermoplastic elastomer alloy or the like.

Also, transfer belt 31 is tensioned by transfer belt drive roller 32, transfer belt driven roller 33 and intermediate transfer rollers 35 so that its surface comes into contact with the outer peripheral surfaces of photoreceptor drums 21, and is adapted to move in the auxiliary scan direction (in the direction of arrow B in the drawing) by the driving force of the transfer belt drive roller 32.

Transfer belt drive roller 32 is disposed at one end side of housing 1*a* and drives the transfer belt 31 by applying a driving force to transfer belt 31 whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the fixing unit 27 side to the other end side of housing 1*a*, in cooperation with transfer belt drive roller 32. However, if the dimension in the width direction of image forming apparatus 1 in FIG. 1 needs to be smaller, that is, if the footprint is made smaller with respect to the width direction in order to achieve space-saving, the position of transfer belt drive roller 32 may be displaced so that transfer belt 31 is inclined in either way from the fixing unit 27 side to the other of housing 1*a* while the photoreceptors, developing units, laser illuminator, fixing unit and other components may be rearranged and resized as appropriate in association with that change in layout.

Intermediate transfer rollers 35 are arranged in the interior space of transfer belt 31 that is wound between transfer belt drive roller 32 and transfer belt driven roller 33 and positioned with their axes shifted relative to corresponding photoreceptor drums 21, in the lateral direction in the drawing, to the downstream side with respect to the moving direction of transfer belt 31, so as to press the inner surface of transfer belt 31 and bring its outer peripheral surface into contact with part of the outer peripheral surface of each photoreceptor drum 21, forming a predetermined amount of nip.

Further, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft. However, the configuration should not be limited to use of these elastic materials.

The thus formed intermediate transfer roller 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over another on transfer belt 31, reproducing the image information that has been input to the apparatus. The thus formed laminated image information is transferred to the recording sheet by transfer roller 36, which is disposed at a position where the recording paper and transfer belt 31 come into contact with each other.

Transfer roller 36 as a constituent of the transfer portion is a component for transferring the developer image transferred to transfer belt 31 to recording paper, and is arranged opposing transfer belt drive roller 32 at approximately the same level and in parallel thereto and pressing against the transfer belt 31 wound on the transfer belt drive roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to deliver the recording sheet that is fed from paper feed portion 109 toward the transfer roller 36 side by aligning the front end of the sheet with the leading end of the toner image on transfer belt 31.

Since the toner adhering to transfer belt 31 as the belt comes in contact with photoreceptor drums 21, or the toner which has not been transferred to the recording sheet by transfer roller 36 and remains on transfer belt 31, would cause contamination of color toners at the next operation, transfer belt cleaning unit 37 is arranged to remove and collect such toner.

Transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the waste toner, left over on and scraped from transfer belt 31 by the cleaning blade 37*a*, to thereby scrape and collect the leftover toner off the transfer belt 31 surface.

Also, transfer belt cleaning unit 37 is arranged near process printing unit 20*a*, on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 1, a pair of fixing rollers 271 consisting of a heat roller 27*a* and pressing roller 27*b*; and a conveying roller 27*c* above the fixing rollers 271. A recording sheet is input from below fixing rollers 271 and output to above conveying roller 27*c*.

Above fixing unit 27 a paper discharge roller 28 is arranged so that the recording sheet conveyed from conveying roller 27*c* is discharged by the paper discharge roller 28 onto paper output tray 43.

Referring to the fixing of a toner image by fixing unit 27, a heating portion (not shown) such as a heater lamp or the like, provided inside or close to heat roller 27*a* is controlled based on the measurement from a temperature detector (not shown) so as to keep heat roller 27*a* at a predetermined temperature (fixing temperature) while the recording sheet with a toner image transferred thereon is heated and pressed between heat roller 27*a* and pressing roller 27*b* as it is being conveyed and rolled thereby, so that the toner image is thermally fused onto the recording sheet.

A duplex printing paper path S3 for double-sided printing is constructed adjacent to fixing unit 27, from the rear side of fixing unit 27 downward to the vicinity of paper feed portion 109. Conveying rollers 29*a* and 29*b* are arranged at the top and bottom and along the duplex printing paper path S3, thereby the recording sheet is inverted and delivered again toward transfer roller 36.

Specifically, conveying roller 29*a* is disposed at the rear of fixing unit 27 and conveying roller 29*b* is located, below conveying roller 29*a* with respect to the top and bottom direction, and at approximately the same level as registration roller 26.

In the present embodiment, heat roller 27*a* employing a heater lamp or the like as a heating portion is used with pressing roller 27*b*, but an induction heating type heating portion may be used alone or in combination with a heater lamp. Further, it is not necessary to use a roller to apply pressure. That is, any appropriate method can be used as long as it can uniformly fix the toner image to the recording paper with heat without causing any image disturbance.

Paper feed portion 109 includes a manual feed tray 41 and paper feed cassette 42 for holding recording paper to be used for image forming, and is adapted to deliver recording paper, sheet by sheet, from manual feed tray 41 or paper feed cassette 42 to image forming portion 108.

As shown in FIG. 1, manual feed tray 41 is arranged at one side end (on the right side in the drawing) of housing 1*a* of image forming apparatus 1 so that it can be unfolded outside when used and folded up to the one end side when unused. This tray delivers paper, one by one, into the housing 1*a* of image forming apparatus 1 when the user places a few recording sheets (necessary number of sheets) of a desired type.

Arranged inside housing 1*a* of image forming apparatus 1 on the downstream side with respect to the manual feed tray 41's paper feed direction of recording paper (the direction of arrow C in the drawing) is a pickup roller 41*a* at the side of exposure unit 10. A conveying roller 41*b* is also disposed at approximately the same level further downstream with respect to the paper feed direction.

Pickup roller 41*a* touches one edge part of the surface of the recording sheet that is fed from manual feed tray 41 and reliably conveys the paper, sheet by sheet, by the function of roller's frictional resistance.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A conveying roller 42*b* is also provided on the downstream side of the pickup roller 42*a* with respect to the pickup roller 42*a*'s feed direction of recording paper.

Pickup roller 42*a* touches one edge part of the surface of the topmost sheet of the recording sheets set on the paper feed cassette 42 in response to a printout request and reliably picks up and feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* toward image forming portion 108.

Next, image output by image forming apparatus 1 of the present embodiment will be described.

Image forming apparatus 1 is constructed so as to transfer the toner images formed on photoreceptor drums 21 to a recording sheet fed from paper feed portion 109 by a so-called intermediate transfer process (offset process) via transfer belt 31.

First, charger 22 uniformly electrifies the outer peripheral surface of photoreceptor drum 21 at a predetermined potential. Each electrified photoreceptor drum 21 is irradiated with a laser beam from exposure unit 10, so that an electrostatic latent image for each color is formed on the photoreceptor drum 21 for the color.

Next, toner is supplied from developing units 23 (23*a*, 23*b*, 23*c* and 23*d*) to the outer peripheral surfaces of photoreceptor drums 21 (21*a*, 21*b*, 21*c* and 21*d*) so that the static latent images formed on the outer peripheral surfaces of photoreceptor drums 21 are visualized with toner so as to form toner images.

Then, the toner image formed on photoreceptor drum 21 is transferred to transfer belt 31.

Transfer of the toner image from photoreceptor drum 21 to transfer belt 31 is done by application of a high voltage from intermediate transfer roller 35 that is arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge on photoreceptor drum 21 is transferred to transfer belt 31 as the photoreceptor drum 21 turns and comes into contact with transfer belt 31.

The toner images of colors formed on respective photoreceptor drums 21 are transferred to transfer belt 31, laid over, one over another, in the order of yellow (Y), magenta (M), cyan (C) and black (BK) as transfer belt 31 moves and comes into contact with each of the rotating photoreceptor drums 21, forming a color toner image on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image having been transferred on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by the function of transfer roller 36 and remains on transfer belt 31, would cause contamination of color toners at the next operation, it is removed and collected by transfer belt cleaning unit 37.

Next, the operation of feeding recording sheets by paper feed portion 109 will be described.

When the recording paper placed on manual feed tray 41 is used, as shown in FIG. 1 the paper is taken in by pickup roller 41*a* from manual feed tray 41, sheet by sheet, at controlled timings in accordance with the instructions from a control panel (not shown), and fed into the machine.

The recording sheet thus taken into the machine is conveyed along recording paper feed path S1 by conveying roller 41*b* to image forming portion 108.

When the recording paper accommodated in paper feed cassettes 42 is used, the paper is separated and fed from paper feed cassette 42, sheet by sheet, by pickup roller 42*a* in accordance with a printout request and conveyed by conveying roller 42*b* along recording paper feed path S2 to image forming portion 108 located above.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with a toner image transferred thereon is conveyed approximately vertically and reaches fixing unit 27, where the toner image is thermally fixed to the recording sheet by heat roller 27*a* and pressing roller 27*b*.

When one-sided printing is selected, the recording sheet having passed through fixing unit 27 is discharged by discharge roller 28 and placed facedown on paper output tray 43.

In contrast, when double-sided printing is selected, the recording sheet is stopped and nipped at paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed. Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged to paper output tray 43 by paper discharge roller 28.

Thus, the transfer operation to recording paper is performed.

Next, the configuration of developing unit 23 and toner supply device 100 according to the present embodiment will be described in detail with reference to the drawings.

Figure 3:
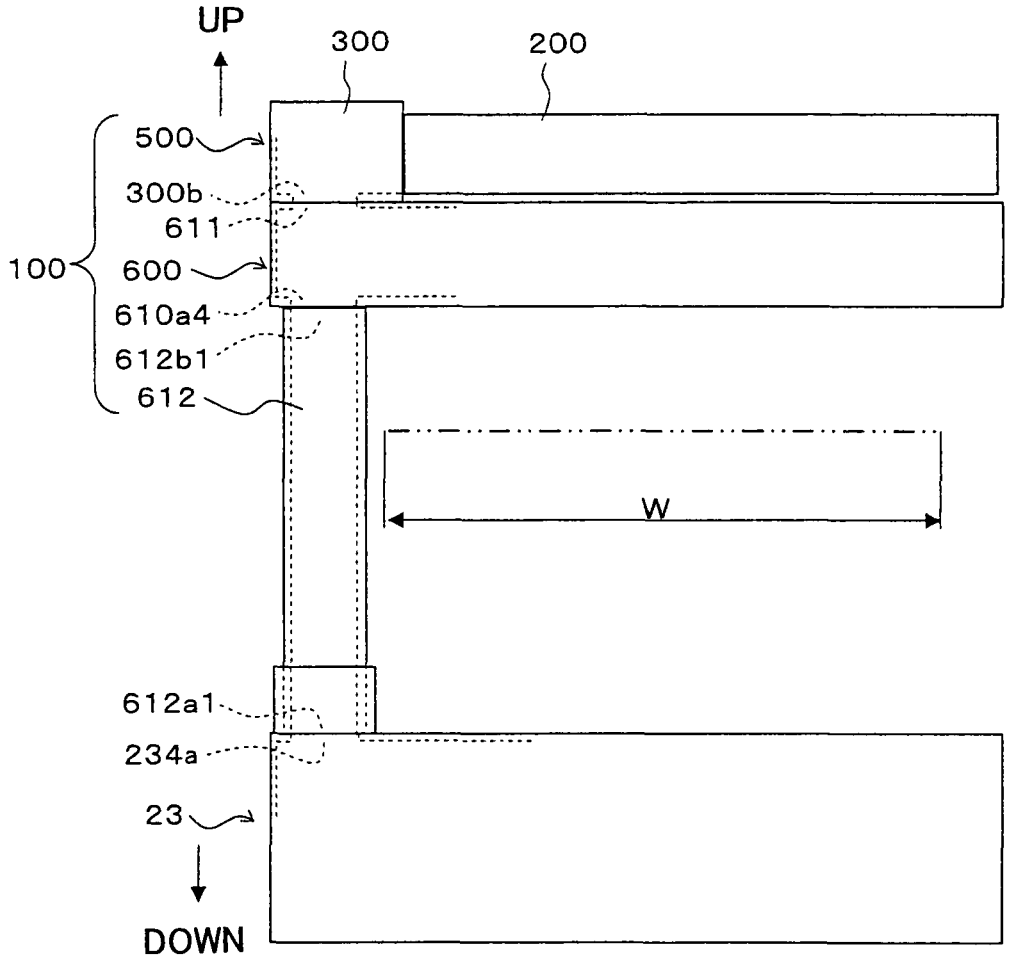
FIG. 3 is an overall front view showing the developing unit and toner supply device.
Figure 4:
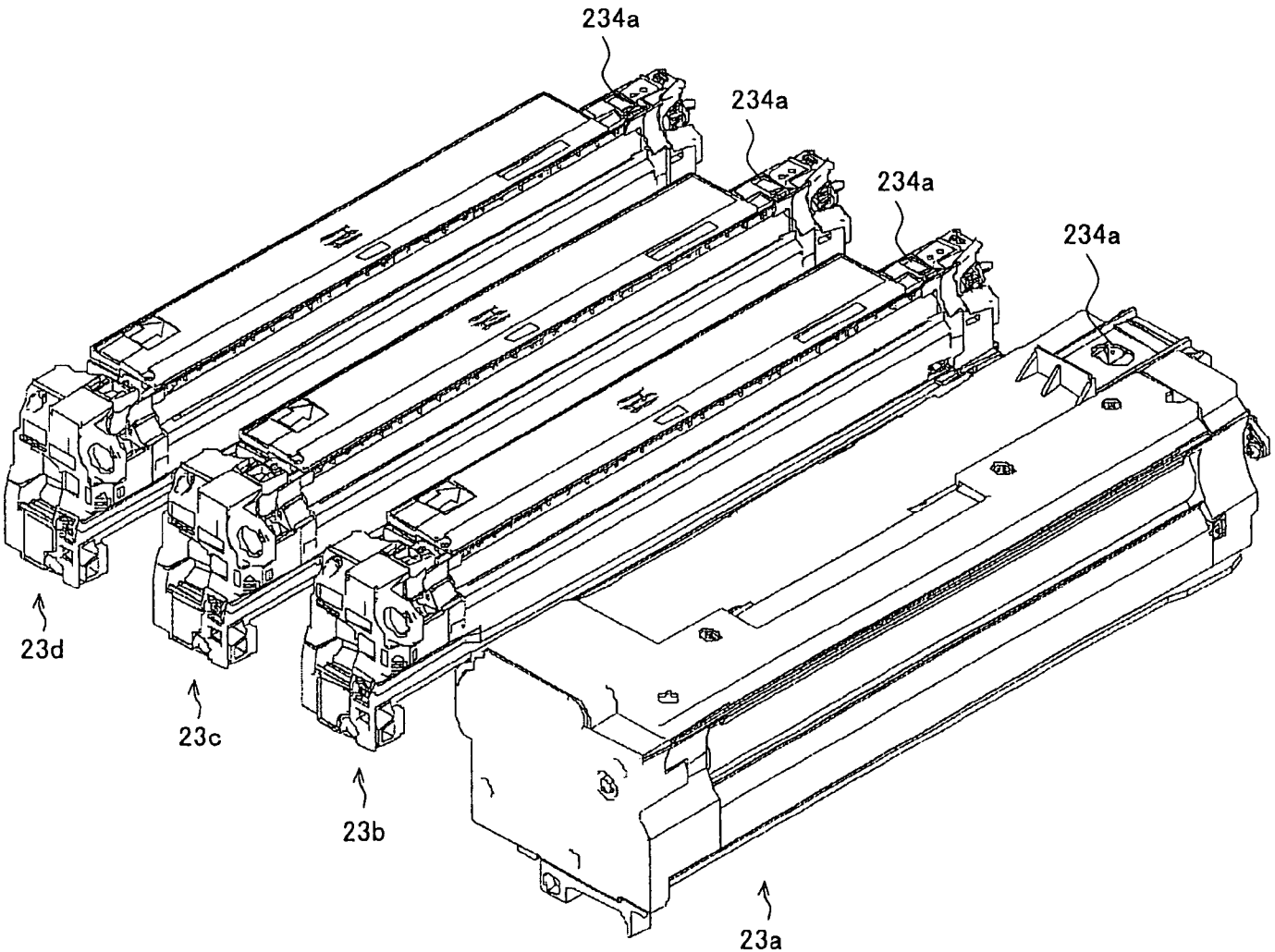
FIG. 4 is a perspective view showing the configuration of the developing unit.
Figure 5:
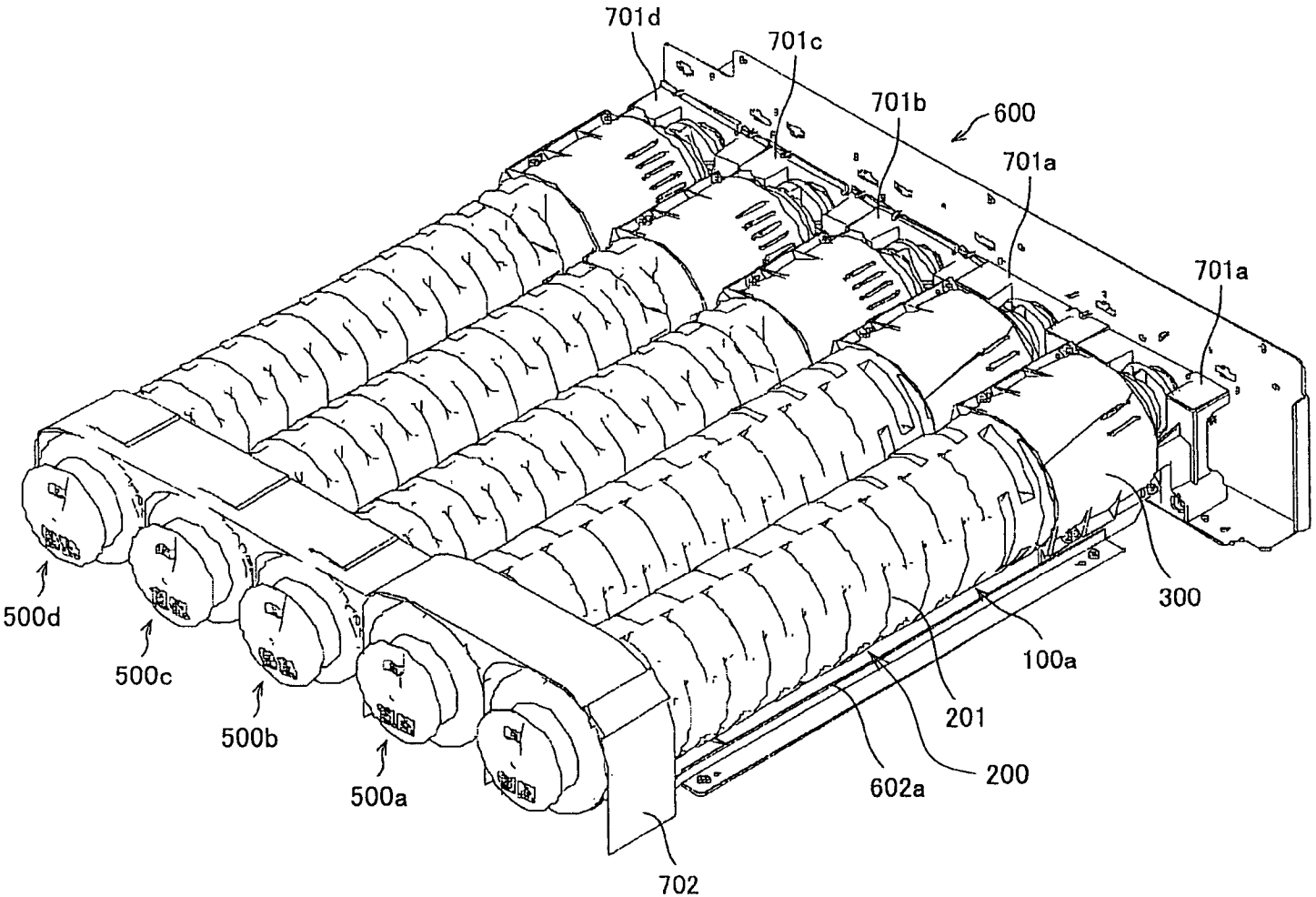
FIG. 5 is a perspective view showing a mounting example when toner supply assemblies are set in toner supply assembly mounting mechanisms that constitute the toner supply devices.
Figure 6:
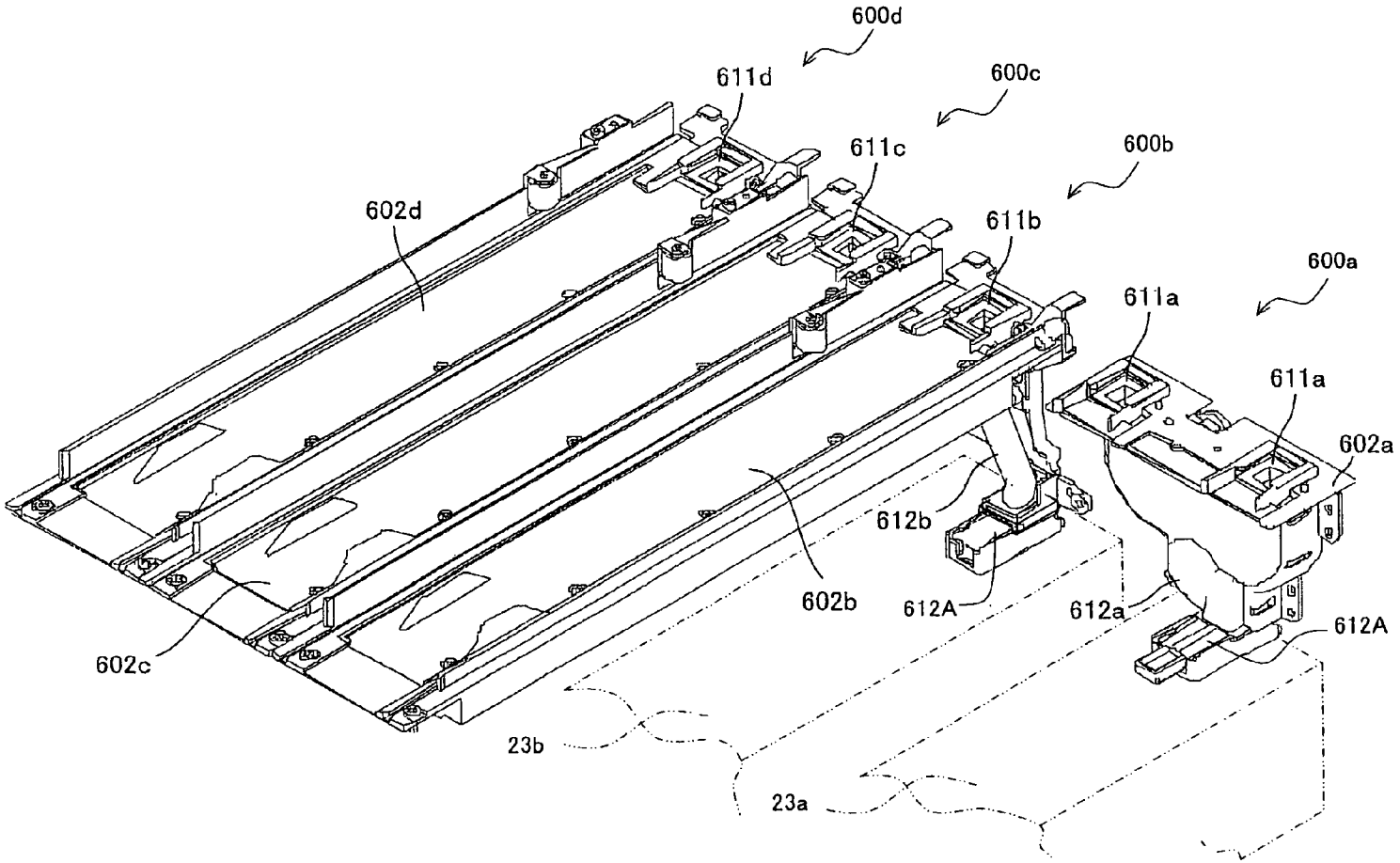
FIG. 6 is a perspective view showing the configuration of the toner supply assembly mounting mechanisms.
Figure 7:
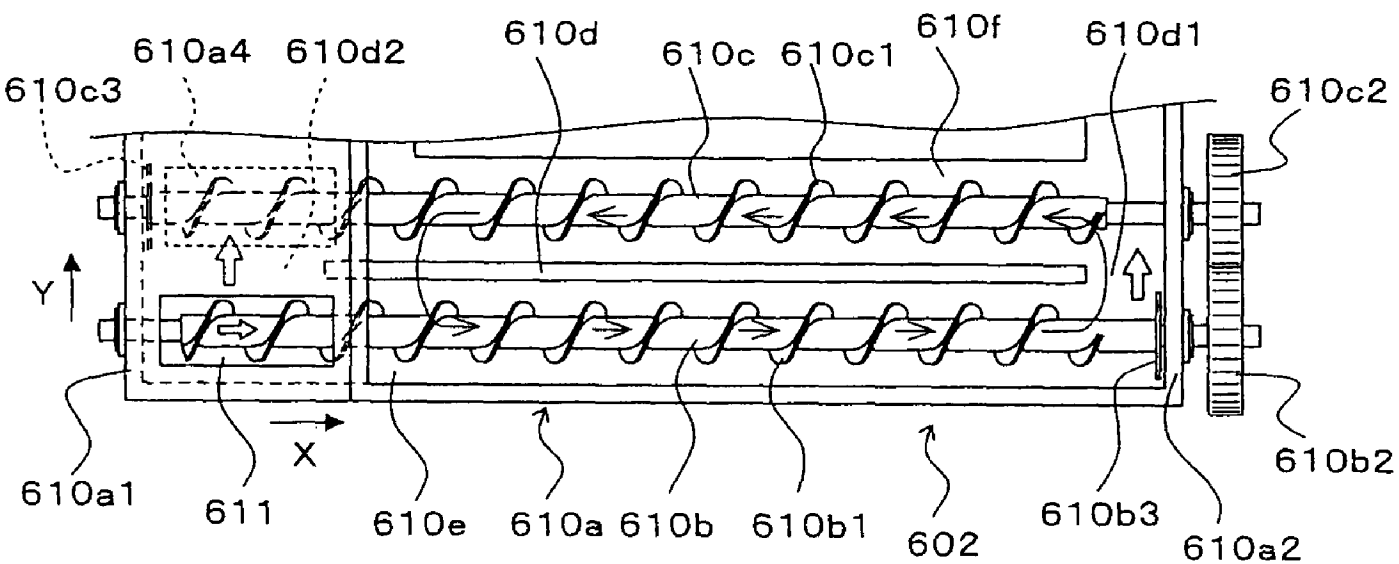
FIG. 7 is an illustrative view showing the configuration of the toner supply assembly mounting mechanism.
Figure 8:
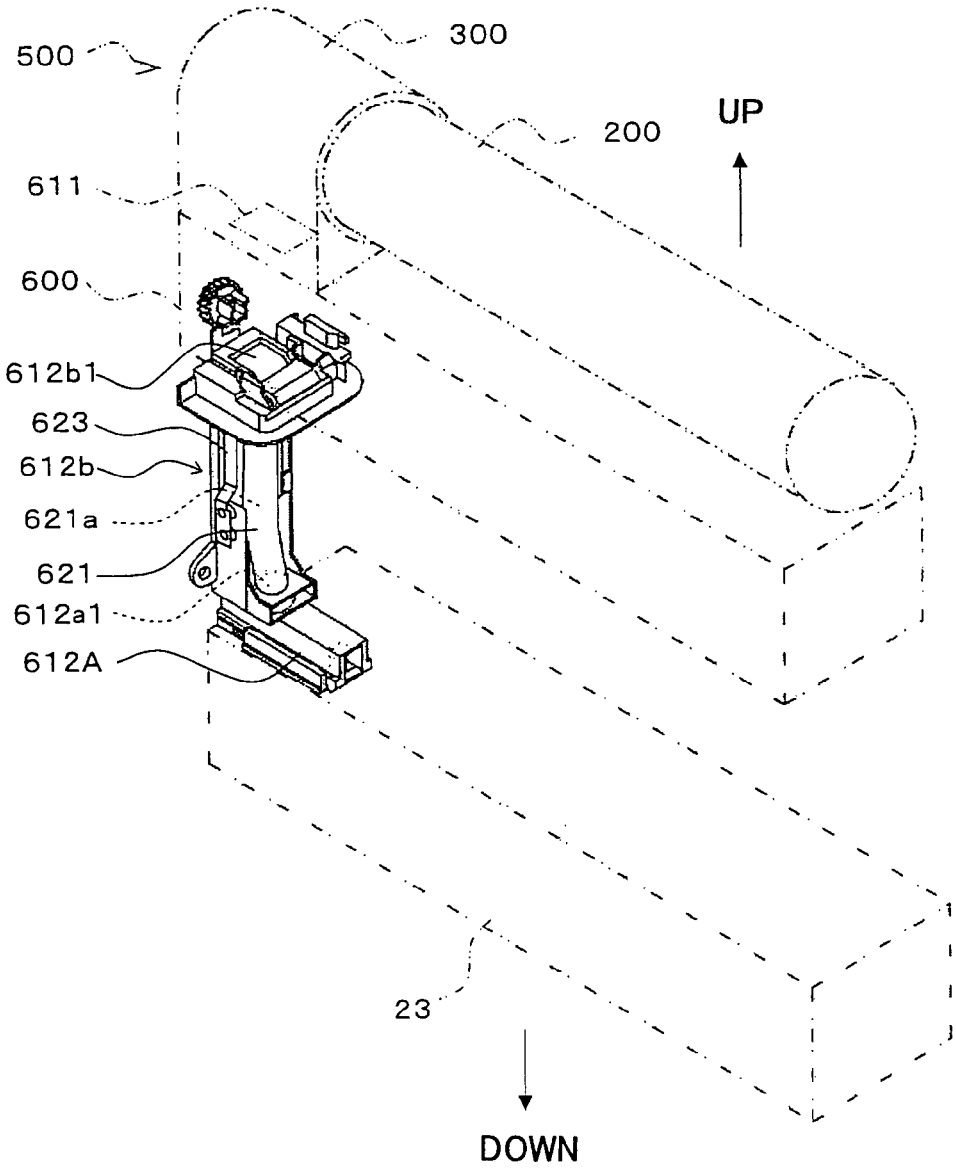
FIG. 8 is an illustrative view showing a configuration of a supply passage assembly for coupling the toner supply assembly mounting mechanism with a developing unit.

FIG. 2 is a schematic side sectional view showing a configuration of a developing unit and a toner supply device that constitute an image forming apparatus of the present embodiment; FIG. 3 is an overall front view showing the developing unit and toner supply device; FIG. 4 is a perspective view showing the configuration of the developing unit mounted to the image forming apparatus according to the present embodiment; FIG. 5 is a perspective view showing a mounting example when toner supply assemblies are set in a toner supply assembly mounting mechanisms that constitute the toner supply devices according to the present embodiment; FIG. 6 is a perspective view showing a configuration of the toner supply assembly mounting mechanisms; FIG. 7 is an illustrative view showing a configuration of the toner supply assembly mounting mechanism; and FIG. 8 is an illustrative view showing a configuration of a supply passage assembly for coupling the toner supply assembly mounting mechanism with a developing unit.

To begin with, developing unit 23 will be described.

As shown in FIGS. 2, 3 and 4, in developing unit 23, a toner input port 234*a* for leading the developer is formed as an opening at the top of a casing 234 that forms its exterior. The developing unit incorporates inside casing 234 a developing roller 231, a first toner conveying roller 232 and a second toner conveying roller 233, and is mounted to the image forming apparatus body with the developing roller 231 opposed, in abutment with, or close to, photoreceptor drum 21. This toner input port 234*a* of developing unit 23 is formed at a position further outside of the transfer belt width W (FIG. 3), on the same side as a toner input port 611 of toner supply assembly mounting mechanism 600 is disposed (FIG. 3).

First toner conveying roller 232 and second toner conveying roller 233 are disposed in the bottom of casing 234 in parallel with each other along the direction of axis of developing roller 231 so that the toner that is fed into casing 234 is agitated with the developer and conveyed to developing roller 231. Developing roller 231 is arranged over and above first toner conveying roller 232 so as to be exposed from an opening mouth 235.

Casing 234 is a box-shaped configuration elongated in the direction (the width W direction of the transfer belt) perpendicular to the direction of transfer (the transfer belt's direction of movement) when mounted in the image forming apparatus body, and is formed with opening mouth 235 so that developing roller 231 therein opposes photoreceptor drum 21 when developing unit 23 is mounted to the image forming apparatus body.

Opening mouth 235 is made open long across the width of casing 234 along the axis direction of developing roller 231 so that at least developing 231 will be able to oppose and abut photoreceptor drum 21. Provided along the bottom edge of opening mount 235 in the drawing is a blade 236 that extends in the axis direction of developing roller 231. Blade 236 is positioned so as to create a predetermined clearance between the blade 236 edge and the developing roller 231 surface, whereby a predetermined amount of toner can be supplied to the developing roller 231 surface through this clearance.

Arranged over the thus constructed developing unit 23 is toner supply device 100.

Referring next to the drawings, the characteristic configuration of toner supply device 100 will be described.

As shown in FIGS. 2 and 3, toner supply device 100 is mainly composed of a toner bottle (toner container) 200 that stores toner as the developer, a toner supply assembly 500 having a bottle holder 300 that rotatably holds the toner bottle 200 at its one end, a toner supply assembly mounting mechanism (toner feed device) 600 to which the toner supply assembly 500 is mounted so as to feed the toner to developing unit 23, and a supply passage assembly 612.

In the present embodiment, any of toner supply assemblies 500*a*, 500*b*, 500*c* and 500*d* for respective toner supply devices 100 (100*a*, 100*b*, 100*c* and 100*d*) mounted in image forming apparatus 1 is assumed to have an identical configuration.

As shown in FIG. 5, toner bottle 200 is comprised of a main part 201 having an approximately cylindrical shape with its front end part supported by bottle holder 300.

Bottle holder 300 is configured in an approximately cylindrical form that covers the front end part of main part 201.

As shown in FIG. 1, toner supply assembly mounting mechanism 600 is constructed such that toner supply assembly 500 is disposed essentially parallel to, and opposing, developing unit 23 with transfer belt unit 30 interposed therebetween. Toner supply assembly mounting mechanism 600*a* for black toner is constructed so that two toner supply assemblies 500*a* for storing black toner can be mounted together.

In toner supply assembly mounting mechanism 600, as shown in FIGS. 3 and 5, mount bases 602 onto which toner supply assemblies 500 are mounted are formed lengthwise in the direction (the transfer belt width W direction) approximately perpendicular to the transfer belt's direction of conveyance.

As shown in FIG. 5, toner supply assemblies 500 are fixed to corresponding drive mechanisms 701, respectively, on the bottle holder 300 side while toner bottles 200 are fixed by holding belts 702 on the opposite side.

Provided for each drive mechanism 701 is an actuator (not shown) which, when toner supply assembly 500 is mounted to mount base 602, transfers driving force (rotational force) to bottle 200 that is rotationally supported by the aforementioned bottle holder 300. Usually, this actuator is composed of a motor, and is controlled to drive in accordance with the toner supply condition.

On the other hand, holding belt 702 is adapted to hold toner bottle 200 of the toner supply assembly 500 when toner supply assembly 500 is mounted to mount base 602, and is removably attached to mount base 602. Holding belt 702 is attached to mount base 602 to hold toner bottle 200, leaving a clearance so that the toner bottle 200 can rotate, or touching the toner bottle 200 with such friction as to allow the bottle to rotate.

In toner supply assembly mounting mechanism 600, as shown in FIG. 6, each mount base 602 on which toner supply assembly 500 is to be mounted, has a toner input port 611 (611*a*, 611*b*, 611*c* or 611*d*) on the upper surface thereof. This toner input port is disposed at one end side on the upper surface where bottle holder 300 of toner supply assembly 500 is mounted. On the underside of the mount base, supply passage assembly 612 (612*a*, 612*b*, 612*c* or 612*d*) for toner conveyance is provided to establish communication between the toner input port 611 and developing unit 23 that is arranged under toner supply assembly mounting mechanism 600.

Here in FIG. 6, for description convenience, mount base 602*a* corresponding to toner supply assembly 500*a* of black toner is partially omitted.

As shown in FIGS. 3 and 6, toner supply assembly mounting mechanisms 600 are constructed such that toner fed from toner supply assembly 500 is delivered from toner input port 611 that is disposed outside the area of the transfer belt with respect to the direction perpendicular to the transfer belt's direction of conveyance, or in short, outside the transfer belt width W.

As shown in FIG. 7 each mount base 602 is formed with a box-shaped casing 610*a* that is elongated in the width direction of the transfer belt. The casing 610*a* incorporates a first toner agitator shaft (toner conveyor portion) 610*b* and a second toner agitator shaft (toner conveyor portion) 610*c*, arranged parallel to each other along the axis direction of developing roller 231.

The interior of casing 610*a* is divided into a first toner chamber (toner reservoir) 610*e* with first toner agitator shaft 610*b* disposed therein and a second toner chamber (toner reservoir) 610*f* with second toner agitator shaft 610*c* disposed therein, by a partitioning element 610*d*.

First and second toner agitator shafts 610*b* and 610*c* have screws 610*b*1 and 610*c*1 for agitating and conveying toner, respectively, and are driven by an unillustrated drive motor by way of drive gears 610*b*2 and 610*c*2 arranged on the other side 610*a*2 of casing 610*a*.

Toner support plates 610*b*3 and 610*c*3 are provided for first and second toner agitator shafts 610*b* and 610*c*, respectively, at their downstream side ends with respect to the toner conveying direction so as to receive the toner being conveyed.

Here, the toner agitating portion should not be limited to screws 610*b*1 and 610*c*1, but it may be a structure in which a multiple number of agitating vanes tilted with the toner conveying direction are formed on the first and second toner agitator shafts 610*b* and 610*c*, for example. Also any other configuration can be used as long as it can produce the same effect.

Partitioning element 610*d* is formed in casing 610*a* across the casing length along the first and second agitator shafts 610*b* and 610*c*, having toner chamber communication ports 610*d*1 and 610*d*2 formed near both side walls of casing 610*a* to allow for communication between first and second toner chambers 610*e* and 610*f*. These toner chamber communication ports 610*d*1 and 610*d*2 permit toner to circulate from first toner chamber 610*e* to second toner chamber 610*f* and from second toner chamber 610*f* to first toner chamber 610*e*.

On the first end side, designated at 610*a*1, of casing 610*a*, a toner input port 611 for receiving toner supply from toner bottle 200 arranged on the top thereof is formed while a toner feed port 610*a*4 for delivering the toner from casing 610*a* to supply passage assembly 612 that feeds toner to developing unit 23 arranged below is formed.

The opening of toner input port 611 is formed at a position opposing part of first toner agitator shaft 610*b* for agitating and conveying toner from first end side 610*a*1 to second end side 610*a*2 of casing 610*a*.

On the other hand, the opening of toner feed port 610*a*4 is formed at a position opposing part of second toner agitator shaft 610*c* for agitating and circulatively conveying toner from second end side 610*a*2 to first end side 610*a*1 of casing 610*a*.

Each of supply passage assemblies 612*b*, 612*c* and 612*d* which are provided on respective mount bases 602 for toner supply assemblies 500 for cyan, magenta and yellow toners is formed so that its top is integrated with toner supply assembly mounting mechanism 600 and a developing unit attachment portion 612A for detachable attachment to developing unit 23 is provided at the bottom thereof, as shown in FIG. 8.

An opening of a toner input port 612*b*1 for toner input is formed at the top of supply passage assembly 612*b*, and a toner passage (toner conveying passage) 621*a* for toner to pass from this toner input port 612*b*1 to toner discharge port 612*a*1 located below is provided approximately linearly from top to bottom.

On the other hand, supply passage assembly 612*a* provided in mount base 602*a* for toner supply assembly 500*a* for black toner has two toner input ports 611*a*, 611*a* corresponding to two toner supply assemblies 500*a*, as shown in FIG. 6. That is, this supply passage assembly is constructed so as to receive toner fed from the two ports and temporarily store together and agitate the toner therein to thereby feed the toner to single developing unit 23*a* for black toner through toner input port 234*a* (FIG. 2) formed in developing unit 23*a*. That is, this supply passage assembly 612*a* has the function of agitating and conveying toner.

Now, the configuration of supply passage assembly 612, which is the characteristic feature will be described with reference to the drawings.

Figure 9:
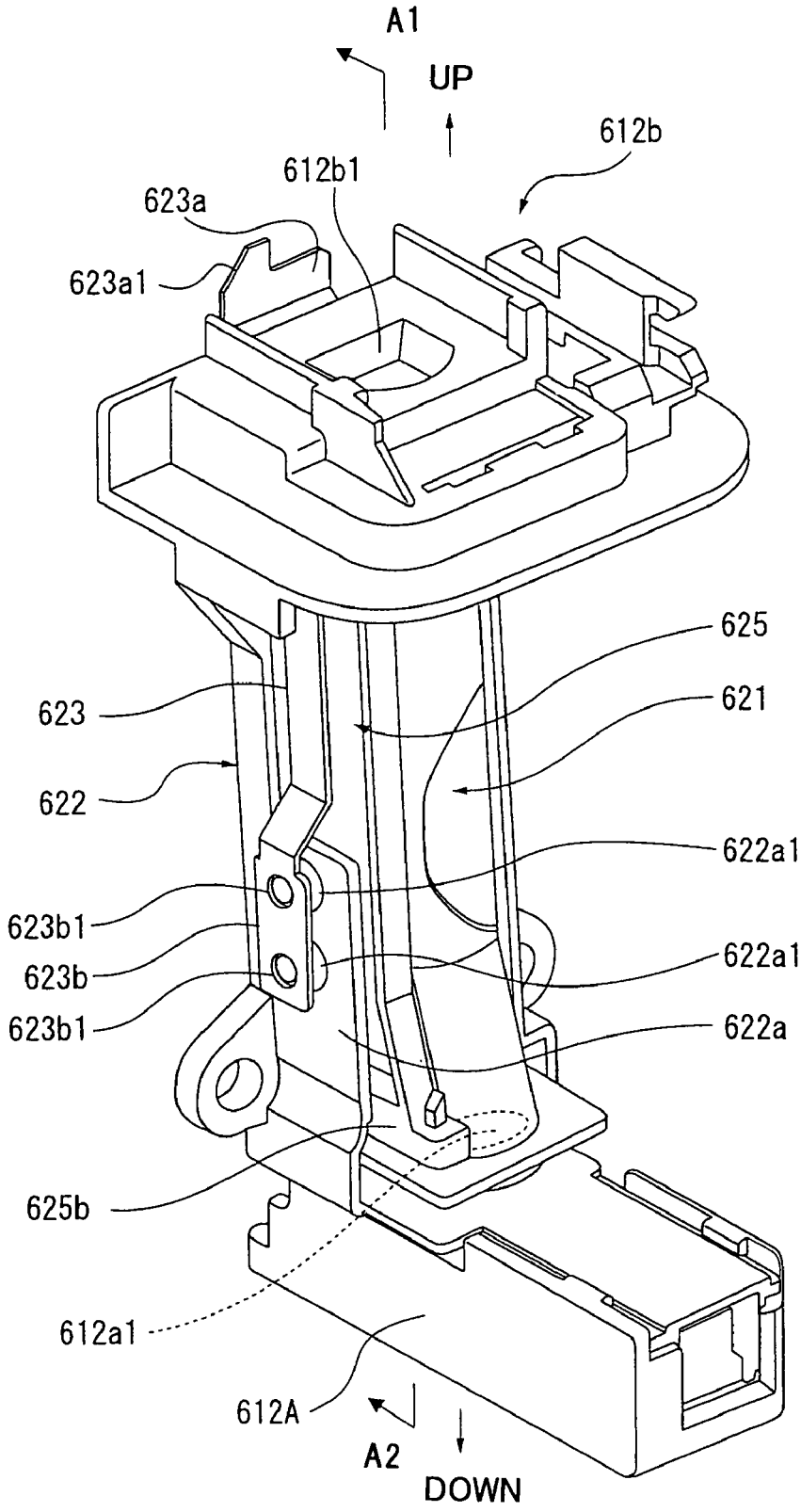
FIG. 9 is an illustrative view showing a configuration of a supply passage assembly for cyan, magenta or yellow toner as a part of the toner supply device.
Figure 10:
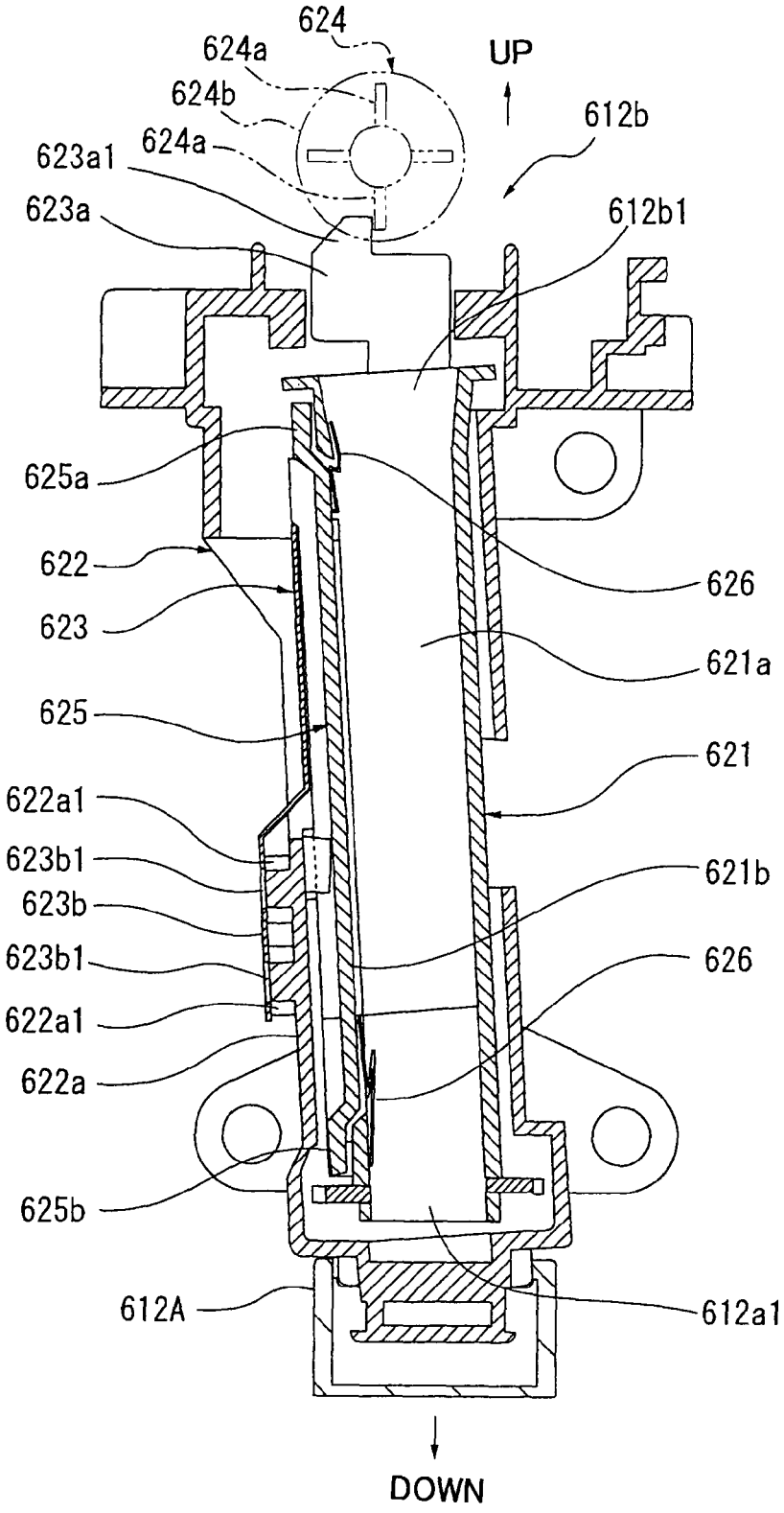
FIG. 10 is a sectional view cut along a plane A1-A2 in FIG. 9.
Figure 11:
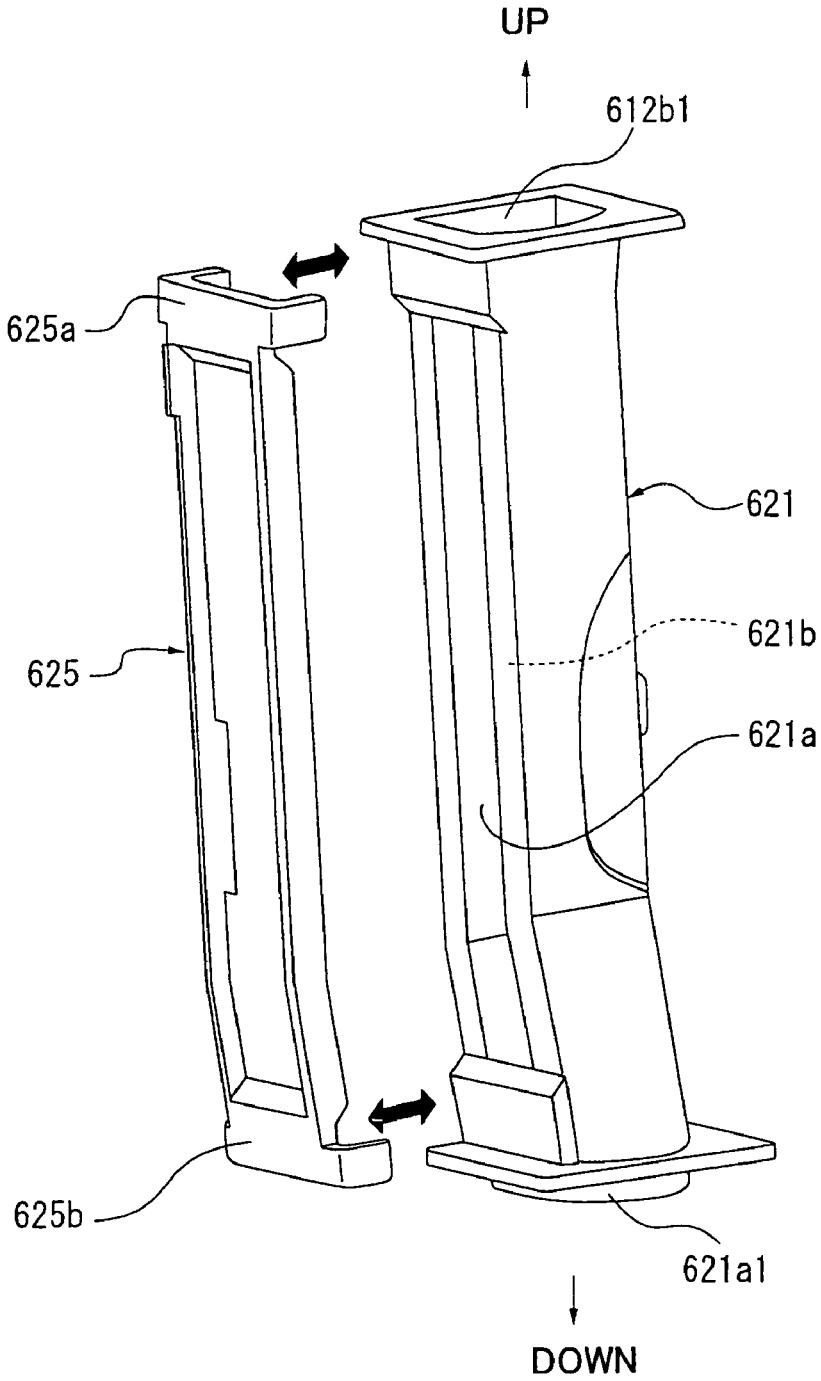
FIG. 11 is an illustrative view showing an arrangement of a toner conveying passage as a part of the supply passage assembly.
Figure 12:
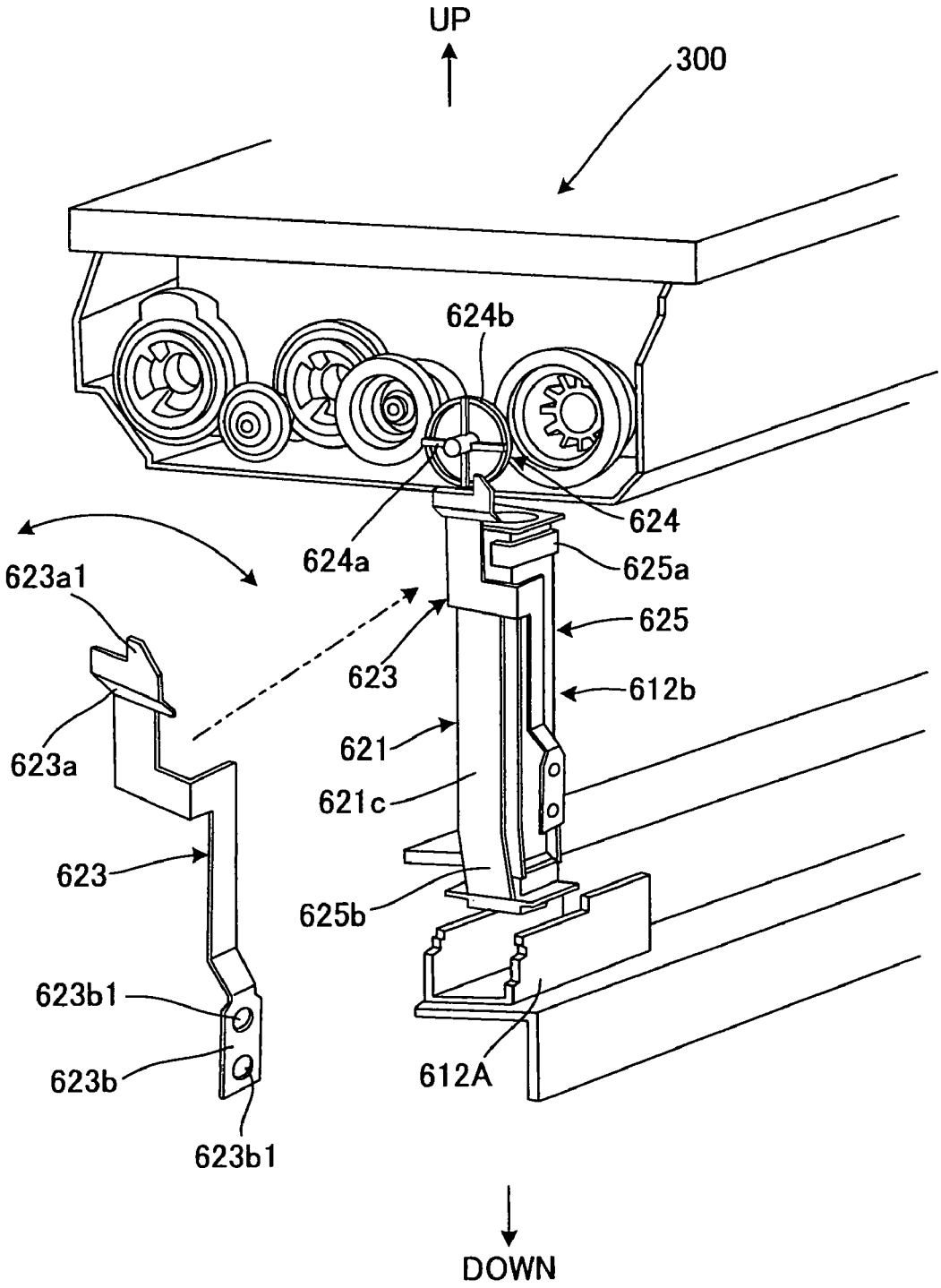
FIG. 12 is an illustrative view showing a configuration of a toner conveying passage deforming portion as a part of the supply passage assembly.

FIG. 9 is an illustrative view showing a configuration of a supply passage assembly for cyan, magenta or yellow toners as apart of a toner supply device according to the present embodiment; FIG. 10 is a sectional view cut along a plane A1-A2 in FIG. 9; FIG. 11 is an illustrative view showing an arrangement of a toner conveying passage as a part of the supply passage assembly; and FIG. 12 is an illustrative view showing a configuration of a toner conveying passage deforming portion as a part of the supply passage assembly.

To begin with, the supply passage assemblies for cyan, magenta and yellow toners, 612*b*, 612*c* and 612*d* will be described by taking supply passage assembly for cyan toner, 612*b*, as an example.

As shown in FIGS. 8 to 10, an opening of a toner input port 612*b*1 for toner input is formed at the top of supply passage assembly 612*b*, so that toner can be conveyed from this toner input port 612*b*1 to toner discharge port 612*a*1.

Supply passage assembly 612*b* includes a toner conveying pipe (toner conveying passage) 621, a pipe supporter 622 for enclosing part of the outer periphery of toner conveying pipe 621 and supporting it, a toner conveying pipe deforming member (toner conveying passage deforming portion) 623 and a rotator 624 (toner conveying passage deforming portion) (FIG. 10) for actuating toner conveying pipe deforming member 623.

Toner conveying pipe 621 is made up of a tubular elastic material that extends vertically, forming an approximately straight toner passage 621*a* (FIG. 8) extending vertically therein. This toner conveying pipe 621 includes a separate partial side wall (to be referred to hereinbelow as "separate side wall") 625 that is separated vertically, as shown in FIG. 11.

In the present embodiment, a smooth curved interior surface is formed inside toner conveying pipe 621 when separate side wall 625 is integrated, thus defining a hollow having an approximately circular section. That is, the interior surface is formed with a smooth surface free from irregularities on which toner particles stagnate.

The inside diameter of toner conveying pipe 621 is minimum at the top end, becomes gradually greater as it goes downstream, and is maximum at the bottom end. In the present embodiment, the inside diameter is 9.5 mm at the top end and 10 mm at the bottom end.

In the present embodiment, creation of the difference between the inside diameters at the top end and bottom end of toner conveying pipe 621 makes the toner input from the top end smoothly reach the bottom end without stagnation midway therethrough. The difference between the inside diameters at the top end and the bottom end to obtain the above effect is, at least, 0.1 mm or greater, preferably 0.2 mm or greater.

Separate side wall 625 is formed of a plastic that is harder than and more difficult to change its shape than toner conveying pipe 621, and has top and bottom engaging parts 625*a* and 625*b* having approximately U-shaped cross sections, arranged at its top and bottom ends.

Top engaging part 625*a* is separably fitted to the top end of toner conveying pipe 621 while bottom engaging part 625*b* is fixed to the bottom end of toner conveying pipe 621. In other words, separate side wall 625 is attached in a swayable manner so that top engaging part 625*a* pivots on bottom engaging part 625*b* in the left and right directions (approximately horizontal directions) relative to toner conveying pipe 621.

Arranged inside toner conveying pipe 621 and at the interface, designated at 621*b*, between toner conveying pipe 621 and separate side wall 625 is an elastically deformable sealing member 626 (FIG. 10) which will be compressed by external force.

This sealing member 626 joins toner conveying pipe 621 and separate side wall 625 so that toner passage 621*a* inside toner conveying pipe 621 will not permit communication with the outside through the interface 621*b*. More explicitly, this sealing member prevents toner from leaking out through interface 621*b* between toner conveying pipe 621 and separate side wall 625.

As shown in FIGS. 9 and 12, pipe supporter 622 has an approximately U-shaped cross-section so as to cover the rear wall, designated at 621*c*, and side walls (including separate side wall 625) of toner conveying pipe 621. The side surface that opposes separate side wall 625, designated at 622*a*, is formed with a rectangular cutout so as to partly expose the upper part of separate side wall 625. Further, bosses 622*a*1 to which toner conveying pipe deforming member 623 is attached is projectively formed on this side surface 622*a*.

As shown in FIG. 12, toner conveying pipe deforming member 623 is formed so that it extends vertically along separate side wall 625 of toner conveying pipe 621 while it is folded around the top part of separate side wall 625 to the rear surface 622*b* side of pipe supporter 622 (FIGS. 13A and 13B) and further is turned upwards along rear surface 622*b*.

Toner conveying pipe deforming member 623 (FIGS. 12 and 13) has an actuating projection 623*a*1 partly projected upwards from its top edge 623*a* on the rear surface 622*b* side of pipe supporter 622. This actuating projection 623*a*1 is adapted to move in linkage with the motion of rotator 624. On the other hand, in the lower part, designated at 623*b*, of member 623 on the separate side wall 625 side, a pair of fitting holes 623*b*1 to be fixed to bosses 622*a*1 are formed.

As shown in FIG. 12, rotator 624 is disposed in the vicinity of the top end of actuating projection 623*a*1 and on the rear surface 622*b* side of the pipe supporter and attached to the toner supply assembly mounting mechanism so that the rotator's axis is positioned perpendicular to the top-to-bottom direction of toner conveying pipe 621.

Rotator 624 is essentially comprised of a plurality of actuating vanes 624*a* that act on actuating projection 623*a*1 and a gear 624*b* that is integrally formed with these actuating vanes 624*a* and drives actuating vanes 624*a*.

Actuating vanes 624*a* and gear 624*b* are disposed on the same axis, the former being arranged on the actuating projection 623*a*1 side with respect to the axis and the latter being arranged at a position on the axis, on the opposite side across actuating vanes 624*a* from that of actuating projection 623*a*1.

In the present embodiment, rotator 624 thus constructed is adapted to rotate as receiving a rotational driving force from the agitating and conveying member that agitates and conveys toner inside toner bottle (toner cartridge) 200. That is, gear 624*b* of rotator 624 is arranged to mesh another gear that transmits the rotational driving force.

In the above configuration, in toner supply device 100 toner bottle 200 is mounted on the top of supply passage assembly (toner conveying device) 612 while developing unit 23 is mounted under supply passage assembly 612. With these three modules set in place, the rotational driving force from the agitating and conveying member provided inside toner bottle 200 is transmitted to rotator 624 of toner supply device 100, whereby rotator 624 can rotate.

Here, the drive for rotator 624 is not limited to the above configuration, but an independent drive source, for example, a motor dedicated for the rotator may be separately provided to drive the rotator.

Also, though rotator 624 should belong to toner supply device 100 from a functional viewpoint because it actuates toner conveying pipe deforming member 623 that acts on toner conveying pipe 621, it may be provided on the toner bottle 200 side from a structural viewpoint.

As to actuating vanes 624*a*, four vanes are radially arranged approximately equi-angularly apart from each other, on a rotational axis that is the same as that of gear 624*b*.

The number of actuating vanes 624*a* is not particularly limited.

Each actuating vane 624*a* rotates as gear 624*b* turns and acts on toner conveying pipe deforming member 623. That is, while gear 624*b* makes one revolution, toner conveying pipe deforming member 623 is actuated four times by actuating vanes 624*a*.

Referring now to the drawings, the action of actuating vanes 624*a* on toner conveying pipe deforming member 623 will be described.

Figure 13A:
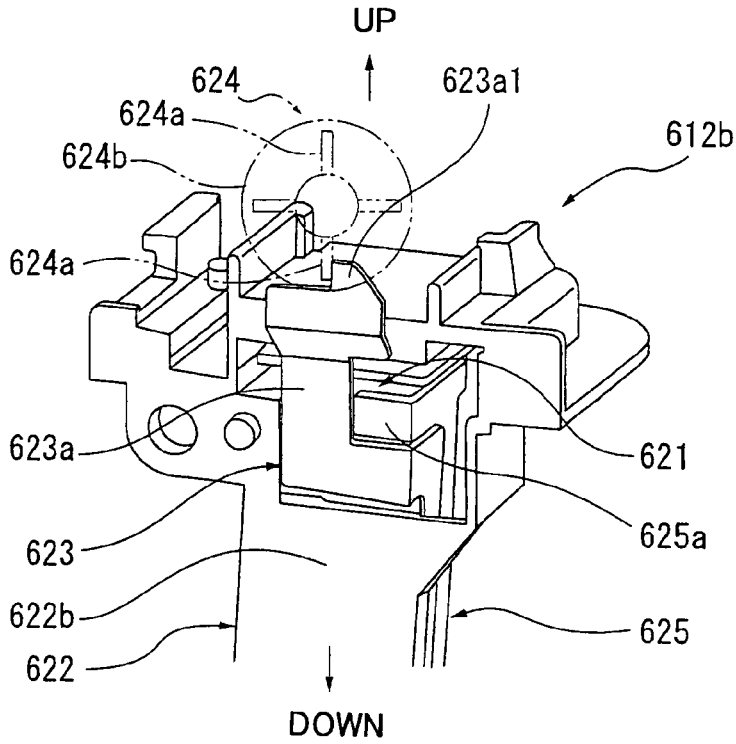
FIG. 13A is an illustrative view showing a state in which a toner conveying passage deforming portion is not in operation.
Figure 13B:
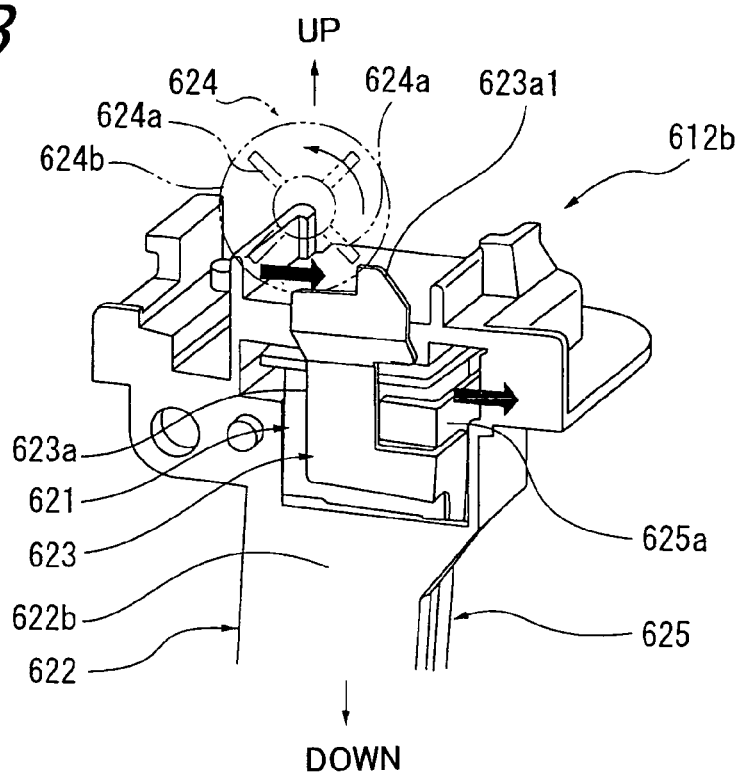
FIG. 13B is an illustrative view showing a state in which a toner conveying passage deforming portion is actuated by actuating vanes.

FIG. 13A is an illustrative view showing a state in which a toner conveying passage deforming portion is not in operation and FIG. 13B is an illustrative view showing a state in which a toner conveying passage deforming portion is actuated by actuating vanes.

Toner conveying pipe deforming member 623, in its normal state, is urged so as to press separate side wall 625 against toner conveying pipe 621, as shown in FIG. 13A.

As rotator 624 turns, one of actuating vanes 624*a* abuts actuating projection 623*a*1 of toner conveying pipe deforming member 623, as shown in FIG. 13B. As the actuating vane 624*a* further rotates, actuating projection 623*a*1 moves in such a direction as to bring separate side wall 625 away from toner conveying pipe 621. Thereby, toner conveying pipe deforming member 623 shifts separate side wall 625 in such a direction that separate side wall 625 moves away from toner conveying pipe 621 (in the left-to-right direction in the drawing).

Since separate side wall 625 is arranged so that its top engaging part 625*a* is separably fitted to the top end of toner conveying pipe 621 while bottom engaging part 625*b* is fixed to the bottom end of toner conveying pipe 621, top engaging part 625*a* pivots on bottom engaging part 625*b* and moves away from toner conveying pipe 621.

As top engaging part 625*a* of separate side wall 625 moves away from toner conveying pipe 621, sealing member 626 at interface 621*b* between separate side wall 625 and toner conveying pipe 621 is expanded. That is, toner passage 621*a* is transformed such that the sectional shape perpendicular to the toner conveying direction gradually becomes greater towards the top of the toner passage.

As the actuating vane 624*a* further rotates, the actuating vane 624*a* comes off the top end of actuating projection 623*a*1. As a result, toner conveying pipe deforming member 623 reverts itself back to the original position due to its own elasticity.

When toner conveying pipe deforming member 623 returns to the original position, separate side wall 625 abuts toner conveying pipe 621. At the same time, sealing member 626 at interface 621*b* between separate side wall 625 and toner conveying pipe 621 becomes compressed. In this way, toner passage 621*a* inside toner conveying pipe 621 reverts itself back to the original state, and the sectional shape approximately perpendicular to the toner conveying direction returns to normal state.

This series of operations is continuously performed so that toner passage 621*a* inside toner conveying pipe 621 deforms and changes its sectional area along the toner conveying direction.

Next, supply passage assembly for black, 612*a*, will be described.

Figure 14:
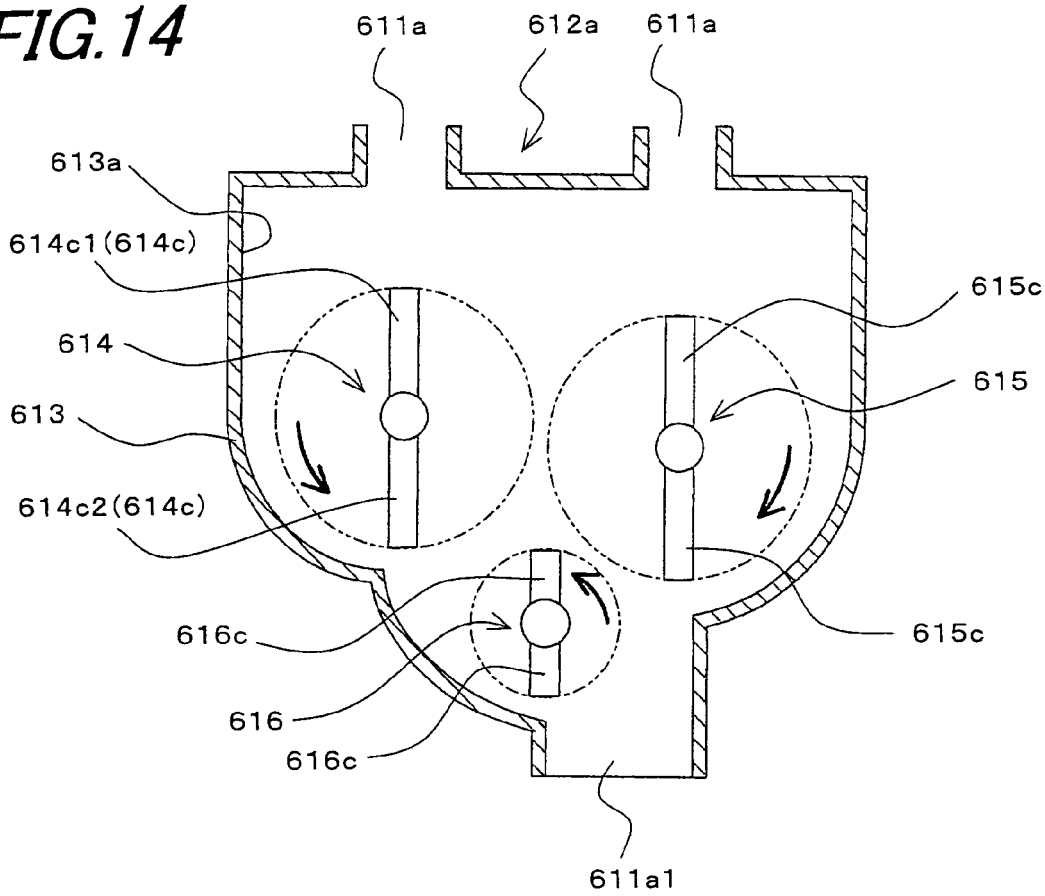
FIG. 14 is an illustrative view showing a configuration of a supply passage assembly for black toner as a part of the toner supply device.
Figure 15:
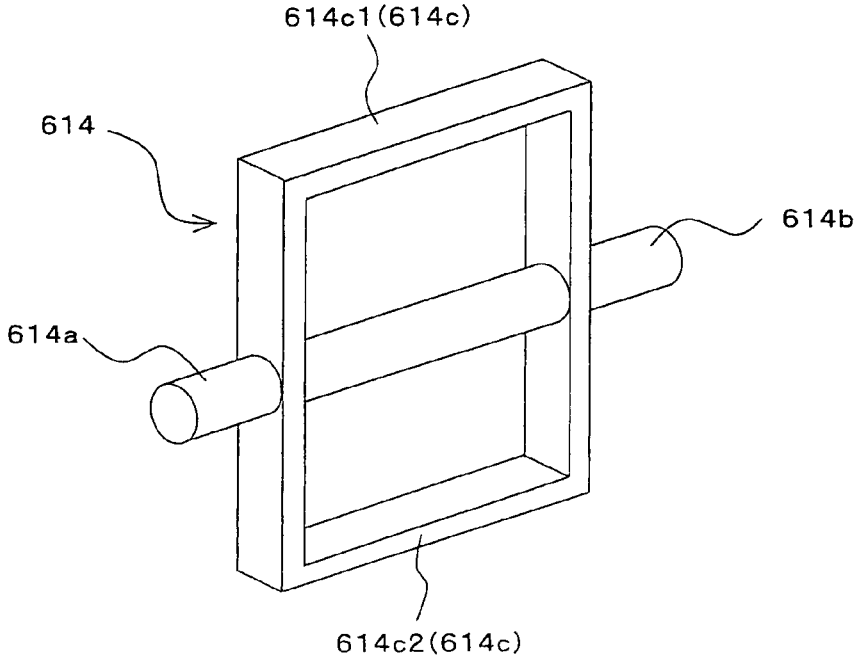
FIG. 15 is an illustrative view showing a configuration of a rotator as a part of the supply passage assembly for black toner.

FIG. 14 is an illustrative view showing a configuration of a black toner's supply passage assembly as a part of the toner supply device according to the present embodiment; and FIG. 15 is an illustrative view showing a configuration of a rotator as a part of the black toner's supply passage assembly.

The exterior of black toner's supply passage assembly 612*a* is formed as a box-like housing 613 having an approximately heart-shaped section viewed from the side, as shown in FIG. 14.

This housing 613 has at its top two toner input ports 611*a*, 611*a* corresponding to two toner bottles 200, and the interior of housing 613 serves as a temporal reservoir for the toner that is supplied from the toner input ports 611*a* and 611*a*.

Inside housing 613, rotators 614, 615 and 616 for agitating toner stored therein are rotatably and axially supported. Also, a toner discharge port 611*a*1 for feeding toner to developing unit 23 is formed at the bottom of housing 613.

Rotators 614 and 615 are disposed under toner input ports 611*a*, 611*a* for receiving toner supply from respective toner bottles 200, 200 while rotator 616 is disposed between, and below, rotators 614 and 615.

In housing 613, its inner wall 613*a* is formed in a circular arc close to rotators 614, 615 and 616 so as not to interfere with the rotational ranges of rotators 614, 615 and 616.

Since rotators 614, 615 and 616 have similar shapes and configurations, description will be made taking an example of rotator 614.

As shown in FIG. 15, rotator 614 is essentially comprised of support shafts 614*a* and 614*b* formed on the same axis and a toner agitation rotor 614*c* formed as a rectangular frame. This toner agitation rotor 614*c* has two linear agitation blades (614*c*1 and 614*c*2), viewed from side, which will axially rotate on support shafts 614*a* and 614*b*. That is, the toner agitation rotor is rotatably and axially supported inside housing 613 by the support shafts 614*a* and 614*b*.

In the present embodiment, as shown in FIG. 14, rotators 614 and 615 are constructed so that their toner agitation rotors 614*c* and 615*c* will not interfere with each other in their rotating ranges and will rotate in opposite directions by the function of meshing gears on the drive side (not shown).

Specifically, toner agitation rotors 614*c* and 615*c* rotate counterclockwise and clockwise, respectively, so that each moves downwards along corresponding inner wall 613*a* of housing 613.

Next, how the supply passage assemblies according to the present embodiment operate in supplying toner will be described.

To begin with, a case for supplying color toner will be described taking an example of cyan toner's supply passage assembly 612*b*.

In the present embodiment, in toner supply device 100 toner bottle 200 is mounted over supply passage assembly (toner conveying device) 612 by means of toner supply assembly mounting mechanism 600 while developing unit 23 is mounted under supply passage assembly 612. With these modules set in place, the rotational driving force from the agitating and conveying member provided inside toner bottle 200 is transmitted to rotator 624 (FIG. 10) of toner supply device 100, so that rotator 624 can rotate.

Toner inside toner bottle 200 (FIGS. 2 and 3) is input into toner supply assembly mounting mechanism 600 of toner supply device 100 by the operation of the agitating and conveying member inside toner bottle 200. The thus input toner is agitated and conveyed in toner supply assembly mounting mechanism 600 and fed to supply passage assembly 612*b*, and further supplied to developing unit 23 through this supply passage assembly 612*b*.

In toner supply device 100, when the operation of supplying toner to developing unit 23 through supply passage assembly 612 as above is performed, rotator 624 rotates as it is receiving the driving force of toner bottle 200 acting on the agitating and conveying member.

As rotator 624 rotates, actuating vanes 624*a* rotate.

As shown in FIGS. 13A and 13B, as actuating vane 624*a* rotates, it abuts actuating projection 623*a*1, and its abutment moves laterally in the drawing as the vane further rotates. As a result, actuating projection 623*a*1 sways laterally, and toner conveying pipe deforming member 623 operates in such a direction as to move separate side wall 625 away from toner conveying pipe 621.

When separate side wall 625 moves away from toner conveying pipe 621, sealing member 626 at interface 621*b* between separate side wall 625 and toner conveying pipe 621 is pulled and expanded, the sectional shape of toner passage becomes greater than that of the normal condition defined by toner conveying pipe 621, separate side wall 625 and sealing element 626. That is, toner passage 621*a* deforms so that its sectional shape approximately perpendicular to the toner conveying direction becomes greater.

As the actuating vane 624*a* further rotates, the actuating vane 624*a* comes off the top end of actuating projection 623*a*1, and toner conveying pipe deforming member 623 reverts itself back to the original position due to its own elasticity. At the same time, sealing member 626 at interface 621*b* between separate side wall 625 and toner conveying pipe 621 becomes compressed so that separate side wall 625 and toner conveying pipe 621 abut each other. That is, toner passage 621*a* inside toner conveying pipe 621 returns to the original state, and the sectional shape approximately perpendicular to the toner conveying direction returns to normal state.

This series of operations is continuously repeated with rotation of rotator 624, whereby toner passage 621*a* that is defined inside toner conveying pipe 621 by toner conveying pipe 621, separate side wall 625 and sealing member 626 deforms continuously, and changes its sectional shape along the toner conveying direction in continuous manner. As a result, toner inside toner passage 621*a* is loosened so as to be able to prevent toner from stagnating and solidifying inside toner conveying pipe 621 hence prevent occurrence of toner conveyance failure.

Next, how black toner's supply passage assembly 612*a* operates in supplying toner will be described.

As shown in FIG. 14, toner to be supplied to supply passage assembly 612*a* from two toner bottles 200 enters housing 613 through two toner input ports 611*a* and 611*a*. Toner fed through toner input ports 611*a* and 611*a* falls around rotators 614 and 615 and is agitated and conveyed by rotators 614 and 615. The toner is further agitated whilst being temporarily reserved inside housing 613.

Then, the toner, as it is further agitated by rotator 616, is conveyed toward toner discharge port 611*a*1.

Specifically, the toner inside housing 613, whilst it being agitated by rotating toner agitation rotors 614*c* and 615*c*, is conveyed from the center of housing 613 to both sides (left and right in the drawing) or toward inner wall 613*a*. Accordingly, the toner can be agitated almost uniformly and distributed to both left and right inside housing 613.

In the present embodiment, since inner wall 613*a* of housing 613 is formed in circular arcs that are close to and along the rotational ranges of toner agitation rotors 614*c* and 615*c*, the toner stored inside housing 613 can be agitated and conveyed without stagnation at and around the inner wall.

Further, since toner agitation rotor 616*c* is arranged between, and below, toner agitation rotors 614*c* and 615*c*, the toner which has been agitated and conveyed by toner agitation rotors 614*c* and 615*c*, from the left and right areas near inner wall 613*a* in housing 613 to the center of housing 613 under the toner agitation rotors 614*c* and 615*c*, can be further agitated by toner agitation rotor 616*c* and conveyed thereby toward toner discharge port 611*a*1.

Moreover, since the inner wall 613*a* of housing 613 near toner agitation rotor 616*c* is also formed in a circular arc close to and along the rotational range of toner agitation rotor 616*c*, the stored toner in housing 613 can be agitated and conveyed without stagnation at around the inner wall.

According to the present embodiment configured as above, in toner supply device 100, supply passage assembly 612 is provided as a toner conveying device, and its toner passage 621*a*, which is formed inside toner conveying pipe 621 and defined toner conveying pipe 621, separate side wall 625 and sealing member 626, is continuously deformed. That is, the sectional shape along the toner conveying direction is continuously changed to loosen the toner inside toner passage 621*a*, whereby it is possible to realize preferable and stable toner conveyance without causing any stagnation of toner inside toner conveying pipe 621 and without causing toner conveyance failure due to solidification of toner.

Further, according to the present embodiment, toner inside toner conveying pipe 621 is moved by deforming toner passage 621*a* of toner conveying pipe 621 without use of a spring agitator or the like which itself might cause stagnation of toner, so as to be able to prevent stagnation and solidification of toner inside toner conveying pipe 621, it is hence possible to easily convey toner and simplify the device configuration.

Since, in the present embodiment, toner conveying pipe 621 serving as the toner conveying passage is formed with a smooth interior surface without irregularities, this configuration also contributes to improvement of the preventing function against stagnation and solidification of toner.

Further, in the present embodiment, since the inside diameter of toner conveying pipe 621 is specified to become gradually greater downwards from the top end at which it is minimum, the toner input from the top end of toner conveying pipe 621 can easily reach the bottom end without stagnation in the middle of the way.

In the present embodiment, since the driving force for rotating the agitating and conveying member of toner bottle 200 is used as the driving force to rotate rotator 624, this makes the driving source dedicated for rotator 624 unnecessary, hence makes it possible to simplify the device configuration.

Also, in the present embodiment, toner conveying pipe 621 is formed of an elastic member, separate side wall 625 as a part of the toner conveying pipe is separately formed of a plastic that is harder than the elastic member, sealing member 626 is provided to join toner conveying pipe 621 and separate side wall 625, and toner passage 621*a* inside toner conveying pipe 621 is transformed by spreading sealing member 626 using toner conveying pipe deforming member 623 so as to change the position of separate side wall 625. However, the technology should not be limited to the above configuration, and any configuration will be included as long as it changes the shape of the toner conveying path.

As a variational example of the present embodiment, it is possible to provide a configuration in which separate side wall 625 moves in the opposite direction by the action of toner conveying pipe deforming member 623, or separate side wall 625 is shifted by toner conveying pipe deforming member 623 in such a direction as to press toner conveying pipe 621.

With this configuration, separate side wall 625 that is formed of harder material (plastic) than that of toner conveying pipe 621 which is made of elastic material is pressed against toner conveying pipe 621, whereby it is possible to elastically deform toner conveying pipe 621, hence changes the shape of toner passage 621*a* that is formed inside toner conveying pipe 621.

When, similarly to the former embodiment, when the above operation is continuously repeated by rotator 624, it is possible to loosen the toner inside toner passage 621*a* in the same manner as the former embodiment, hence realize preferable and stable toner conveyance without causing any stagnation of toner inside toner conveying pipe 621 and without causing any toner conveyance failure due to toner solidification.

Further, in the former embodiment and the above variational example, toner conveying pipe 621 is formed of elastic material while separate side wall 625 as a part of the toner conveying pipe 621 is formed of a plastic that is harder than the elastic material. However, the technology should not be limited to the above configuration. For example, as a variation, toner conveying pipe 621 may be formed of a hard plastic while separate side wall 625 may be formed of elastic material.

With this arrangement, toner passage 621*a* inside toner conveying pipe 621 can be changed in shape by deforming separate side wall 625, hence it is possible to obtain the same effect as in the former embodiment and its variational example.

Further, as another example it is possible to provide a configuration in which the toner conveying pipe is integrally formed with a component made of elastic material corresponding to separate side wall 625 while the component corresponding to the separate side wall 625 may be deformed by a component corresponding to toner conveying pipe deforming member 623.

With this configuration, it is possible to obtain the same effect as in the former embodiment and its variational example, still, the toner passage formed inside toner conveying pipe can be deformed with a simple structure.

Though the present embodiment has been described taking an example in which toner supply device 100 is applied to the image forming apparatus shown in FIG. 1, the technology should not be limited to this. For example, the toner supply device may be applied to a copier 101 as shown in FIG. 16.

Figure 16:
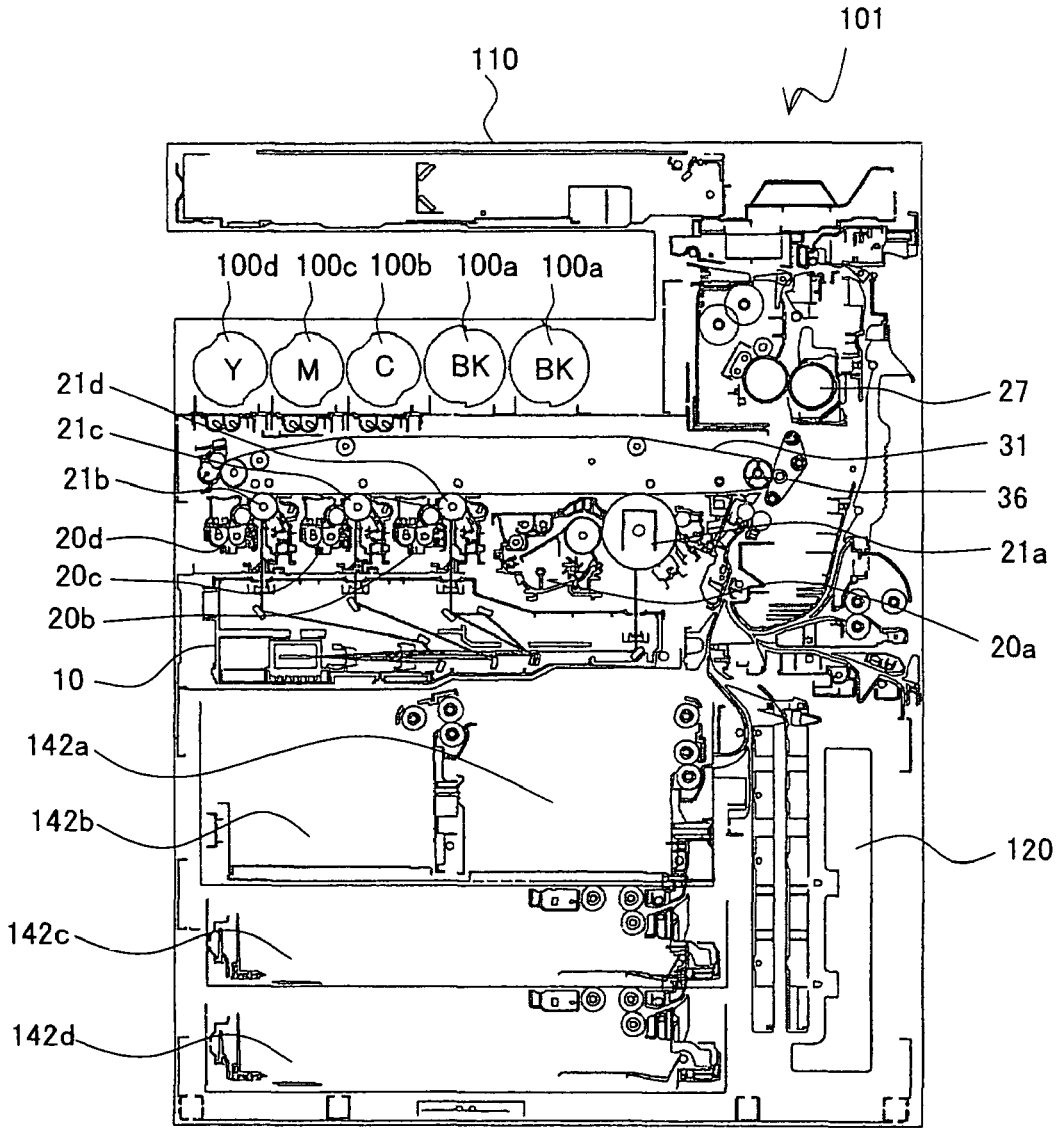
FIG. 16 is an illustrative view showing an overall configuration of a copier.

As shown in FIG. 16, copier 101 includes an image reader (scanner) 110 disposed above an image forming portion 108 having almost the same configuration as that of image forming apparatus 1 according to the present embodiment, and first, second, third and fourth paper feed cassettes 142*a*, 142*b*, 142*c* and 142*d* disposed under image forming portion 108 for supporting multiple kinds of paper, to thereby facilitate a variety of and a large amount of automatic printing.

In the drawing, a reference numeral 120 designates a waste toner box for collecting waste toner.

Here, in copier 101, the same components as those in image forming apparatus 1 of the aforementioned embodiment will be allotted with the same reference numerals and description is omitted.

According to the thus configured copier 101, application of toner supply devices 100 including supply passage assemblies 612 to the above-described toner conveying devices makes it possible to achieve the same effect as obtained in the image forming apparatus 1 of the above embodiment mode.

Further, the technology can be developed into any form of other kinds of image forming apparatuses etc., not limited to the image forming apparatus and copier having the above configurations, as long as it is an image forming apparatus needing a supply of developer (toner).

As has been described above, the technology should not be limited to the above embodiment, and various changes can be made within the range specified in the scope of claims. That is, any embodied mode obtained by combination of technical means modified as appropriate without departing from the spirit and scope of the technology should be included in the technical art of the technology.

What is claimed is:

1. A toner conveying device arranged under a toner container for storing toner, comprising:

a toner conveying passage for conveying toner supplied from the toner container to a developing unit arranged below, wherein at least a portion of the toner conveying passage is formed of an elastic material, the toner conveying passage comprising:

a toner conveying pipe having an opening along one side thereof, and a partial sidewall that covers the opening in the toner conveying pipe, wherein the partial sidewall is movable with respect to the toner conveying pipe; and a toner conveying passage deforming portion coupled to the partial sidewall, wherein the toner conveying passage deforming portion causes the partial sidewall to move with respect to the toner conveying pipe.

2. The toner conveying device according to claim 1, wherein the toner conveying passage is formed at the top end thereof with a toner input port that is connected to the toner container side and at the bottom end thereof with a toner discharge port that is connected to the developing unit side, and the path of toner conveyance from the toner input port to the toner discharge port is formed to be straight.

3. The toner conveying device according to claim 1, wherein part of the exterior wall of the toner conveying passage is formed of an elastic material.

4. The toner conveying device according to claim 1, wherein the toner conveying passage deforming portion applies an external force to the toner conveying passage to change a sectional shape of the toner conveying passage.

5. The toner conveying device according to claim 1, wherein the toner conveying passage deforming portion comprises a deforming member for pressing part of the external wall of the toner conveying passage in a direction that is approximately perpendicular to the toner conveying direction.

6. The toner conveying device according to claim 5, wherein the toner conveying passage deforming portion is adapted to change the pressing force of the deforming member acting on the toner conveying passage with passage of time.

7. The toner conveying device according to claim 5, wherein the deforming member applies an external force to a part that is formed of an elastic material in the toner conveying passage.

8. The toner conveying device according to claim 5, wherein the deforming member applies an external force to a part that is not formed of an elastic material in the toner conveying passage.

9. The toner conveying device according to claim 1, further comprising a toner feeder for feeding toner from the toner container to the toner conveying passage, wherein the toner conveying passage deforming portion moves in linkage with the driving operation of the toner feeder.

10. A toner supply device including a toner container for storing toner and a toner conveying device arranged under the toner container and having a toner conveying passage for conveying toner supplied from the toner container to a developing unit arranged below, so as to feed the toner supplied from the toner container to the developing unit, characterized in that a toner conveying device defined in claim 1 is used as the toner conveying device.

11. An image forming apparatus in which a toner supply device including a toner container for storing toner and a toner conveying device arranged under the toner container and having a toner conveying passage for conveying toner supplied from the toner container to a developing unit arranged below, so as to feed the toner supplied from the toner container to the developing unit is mounted, characterized in that a toner supply device defined in claim 10 is used as the toner supply device.

* * * * *